US008384656B2

(12) United States Patent
Ito

(10) Patent No.: US 8,384,656 B2
(45) Date of Patent: Feb. 26, 2013

(54) DRIVING DEVICE, ELECTRO-OPTICAL DEVICE, AND ELECTRONIC APPARATUS

(75) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 1145 days.

(21) Appl. No.: 12/266,333

(22) Filed: Nov. 6, 2008

(65) Prior Publication Data

US 2009/0122035 A1 May 14, 2009

(30) Foreign Application Priority Data

Nov. 9, 2007 (JP) ..... 2007-291961

(51) Int. Cl.
*G09G 3/36* (2006.01)

(52) U.S. Cl. ..... 345/103; 345/89; 345/204; 345/690

(58) Field of Classification Search ..... 345/87–100, 345/204, 211–213, 690, 38–58, 76–86, 103; 315/169.1–169.4
See application file for complete search history.

(56) References Cited

U.S. PATENT DOCUMENTS

| | | | | |
|---|---|---|---|---|
| 7,091,937 | B2 | 8/2006 | Nakamura | |
| 2005/0007392 | A1* | 1/2005 | Kasai et al. | 345/690 |
| 2005/0041488 | A1* | 2/2005 | Ito et al. | 365/199 |
| 2006/0012555 | A1* | 1/2006 | Tokumura | 345/98 |
| 2008/0309599 | A1* | 12/2008 | Tsuda et al. | 345/88 |

FOREIGN PATENT DOCUMENTS

| | | |
|---|---|---|
| JP | 2003-157051 | 5/2003 |
| JP | 2004-045967 | 2/2004 |
| JP | 2004-045967 A | 2/2004 |
| JP | 2005-043418 | 2/2005 |
| JP | 2005-156962 A | 6/2005 |
| JP | 2007-003967 A | 1/2007 |

* cited by examiner

*Primary Examiner* — Amare Mengistu
*Assistant Examiner* — Koosha Sharifi-Tafreshi
(74) *Attorney, Agent, or Firm* — Maschoff Gilmore & Israelsen

(57) ABSTRACT

A driving device for driving an electro-optical device includes an outputting section that divides original image signal into and outputs a number of signal portions. The number corresponds to a number of groups of data lines. An assigning section assigns the signal portions to the data lines of corresponding group. A changing section determines an order that the signal portions are to be supplied to the data lines of the corresponding group and changes the order. A correcting section corrects the signal portions to reduce a difference in brightness in the display area generated by the changed order of the signal portions. A supplying section supplies the corrected signal portions to the data lines in accordance with the changed order.

18 Claims, 11 Drawing Sheets

FIG. 10

| | DO1 | | | | DO2 | | | |
|---|---|---|---|---|---|---|---|---|
| | X1 | X2 | X3 | X4 | X5 | X6 | X7 | X8 |
| 1H | 1 | 2 | 3 | 4 | 1 | 2 | 3 | 4 |
| 2H | 2 | 3 | 4 | 1 | 2 | 3 | 4 | 1 |
| 3H | 3 | 4 | 1 | 2 | 3 | 4 | 1 | 2 |
| 4H | 4 | 1 | 2 | 3 | 4 | 1 | 2 | 3 |
| 5H | 1 | 2 | 3 | 4 | 1 | 2 | 3 | 4 |

DRIVING DEVICE, ELECTRO-OPTICAL DEVICE, AND ELECTRONIC APPARATUS

BACKGROUND

1. Technical Field

The present invention relates to a device and a method for driving an electro-optical device such as a liquid crystal device or the like. In addition, the invention relates to an electro-optical device that is provided with such a driving device and an electro-optical device that is operated by such a driving method. Moreover, the invention further relates to an electronic apparatus that is provided with such an electro-optical device. A non-limiting example of an electronic apparatus to which the invention is directed is a liquid crystal projector.

2. Related Art

In the technical field to which the present invention pertains, a driving device that supplies an image signal to each of a plurality of data line groups has been proposed. In the configuration of such a driving device of the related art, each of the plurality of data line groups is made up of more than one data line. For example, a technique that supplies an image signal that has been subjected to time-series division processing to each of a plurality of data line groups, which is made up of a plurality of data lines, is described in JP-A-2005-43418. With such a driving technique of the related art, it is possible to avoid the number of connection lines/wires from increasing in a circuit configuration even when the number of pixels increases so as to achieve, for example, higher definition.

In addition to the technique of the related art explained above, another technique that changes the sequential order of the supply of image signals to data lines at each lapse of a predetermined time period has also been proposed in the related art as a technique that can be combined with the first-mentioned driving technique of the related art. For example, a technique for preventing the occurrence of display unevenness, which is achieved by changing the sequential order of the supply of image signals to data lines at each lapse of one horizontal time period, is described in JP-A-2004-45967.

However, if the above-explained technique of the related art that changes the sequential order of the supply of image signals to data lines at each lapse of one horizontal time period is adopted, a brightness level changes on a display screen in accordance with the change in the sequential order of the supply of image signals. Accordingly, a partial brightness change becomes more perceivable. For this reason, even though the problem of display unevenness due to a difference in brightness does not arise, which is achieved by changing the sequential order of the supply of image signals to data lines, there is an adverse possibility of the occurrence of another image problem such as the flickering of a display screen, though not limited thereto, which is attributable to a brightness level change on a display screen in accordance with the change in the sequential order of the supply of image signals. As explained above, these techniques of the related art have a technical disadvantage in that it is difficult to achieve high display quality.

SUMMARY

An advantage of some aspects of the invention is to provide a driving device and a driving method that is capable of displaying an image with high quality. In addition, the invention provides, as an advantage of some aspects thereof, an electro-optical device that is provided with such a driving device and an electro-optical device that is operated by such a driving method. Moreover, the invention further provides, as an advantage of some aspects thereof, an electronic apparatus that is provided with such an electro-optical device.

In order to address the above-identified problem without any limitation thereto, the invention provides, as a first aspect thereof, a device for driving an electro-optical device, the driving device correcting an original non-corrected image signal that indicates an image that is to be displayed in a display area of the electro-optical device, the driving device supplying the corrected image signal to a plurality of data lines in the display area of the electro-optical device so as to drive the electro-optical device, the driving device including: an outputting section that divides the original non-corrected image signal into a plurality of non-corrected signal portions whose number corresponds to the number of groups of the data lines where each group thereof is made up of a predetermined number of data lines, and then outputs the signal portions; an assigning section that assigns each of the signal portions to the above-mentioned predetermined number of data lines that make up the corresponding group, the assignment to the above-mentioned predetermined number of data lines being performed in a sequential manner; a changing section that changes the sequential order of the assignment of each of the signal portions to the above-mentioned predetermined number of data lines that make up the corresponding group; a correcting section that corrects the gradations of the signal portions so as to reduce a difference in brightness in the display area of the electro-optical device, which is attributable to a change in the sequential order of the assignment of each of the signal portions to the above-mentioned predetermined number of data lines that make up the corresponding group; and a supplying section that supplies the corrected signal portions to the data lines in accordance with the above-mentioned sequential order.

When a driving device according to the first aspect of the invention, which has the configuration described above, is operated, an outputting section divides an original non-corrected image signal, which indicates (e.g., contains information on) an image that is to be displayed in the display area of an electro-optical device, into a plurality of non-corrected signal portions. Thereafter, the outputting section outputs the signal portions. The number of signal portions corresponds to the number of groups of the data lines where each group thereof is made up of a predetermined number of data lines. An assigning section assigns each of the signal portions to the above-mentioned predetermined number of data lines that make up the corresponding group. Herein, the assignment to the above-mentioned predetermined number of data lines is performed in a sequential manner. That is, the signal portion is subjected to time division (i.e., time sharing) and then assigned to the above-mentioned predetermined number of data lines that make up the group. The assignment of the signal portions described above may be performed as a result of outputting them to lines that are different from one another. Or, alternatively, the assignment of the signal portions described above may be performed as a result of setting the sequential order of the supply thereof to the data lines.

In the configuration of a driving device according to a first aspect of the invention described above, a changing section changes the sequential order of the assignment of each of the signal portions to the above-mentioned predetermined number of data lines that make up the corresponding group. In the following description of this specification, the sequential order of the assignment of each of the signal portions to the above-mentioned predetermined number of data lines that make up the corresponding group may be simply referred to as "sequential order". As a result of the changing of the sequential order, the timing of supply of the signal portions to the data lines changes. The sequential order is changed, for example, at each lapse of a predetermined time period. Although the same single change pattern is shared among the plurality of data line groups in a typical configuration example thereof, the scope of the invention is not limited to such a typical example. That is, the change pattern that is applied to one data line group may differ from the change pattern that is applied to another data line group. In other words, the sequential order may be changed while maintaining correspondence among the plurality of data line groups, or alternatively, may be changed independently of one another.

When the signal portions are assigned as explained above, the timing of the supply of the signal portion differ from one data line to another. Because of such a timing difference, a brightness difference could occur in the display area of an electro-optical device. For example, even in a case where a signal portion having the same gradation is supplied to all data lines that make up one data line group (e.g., even in a case where signal portions having the same gradation are supplied to all data lines, a predetermined number of which make up each data line group) brightness may differ between one end and the other opposite end. For example, even in such a case, brightness may differ between the left edge and the right edge or between the top edge and the bottom edge depending on the sequential order defined above. Or, even in the same case as above where a signal portion having the same gradation is supplied to all data lines that make up one data line group, brightness may differ between the center and both ends. For example, even in such a case, brightness may differ between the center and the left edge as well as between the center and the right edge depending on the sequential order. In addition, even in such a case, brightness may differ between the center and the top edge as well as between the center and the bottom edge depending on the sequential order. The reason why such a brightness difference arises is that the length of a time period from the writing of an image signal to the actual end of display or the actual start of display differs from one to another. Such a brightness difference could cause display unevenness in the display area of an electro-optical device.

As explained above, in the configuration of a driving device according to a first aspect of the invention, the changing section changes the sequential order of the assignment of each of the signal portions to the above-mentioned predetermined number of data lines that make up the corresponding group. When the sequential order of the assignment of signal portions to the data lines is changed, some area portion at which a brightness level differs from that of other area portion moves in accordance with the changed sequential order thereof in the display area of an electro-optical device. In particular, the movement of a high luminance area portion is visually perceivable. As a disadvantageous effect of such movement of a high brightness area portion, the flickering of a display screen, though not limited thereto, could be visually recognized in the display area of an electro-optical device.

In this respect, in the configuration of a driving device according to a first aspect of the invention described above, a correcting section corrects the gradations of the signal portions so as to reduce a difference in brightness in the display area of the electro-optical device, which is attributable to a change in the sequential order of the assignment of each of the signal portions to the above-mentioned predetermined number of data lines that make up the corresponding group. Therefore, if the configuration of a driving device according to the first aspect of the invention described above is adopted, it is possible to prevent the occurrence of flicker or other similar image problem, which is attributable to a change in the sequential order of the assignment of signal portions to data lines, while preventing the occurrence of display unevenness or other similar display failure due to a brightness difference. The amount of brightness level change depends on the timing of the supply of the signal portions. For this reason, if the sequential order of the assignment of signal portions to data lines is known, it is possible to predict the amount of brightness level change and performs correction thereon. That is, after the assigning section has assigned each of the signal portions to the above-mentioned predetermined number of data lines that make up the corresponding group, it is possible to predict the amount of brightness level change and correct the signal portions. Or, even after the changing section has changed the sequential order of the assignment of each of the signal portions to the above-mentioned predetermined number of data lines that make up the corresponding group, it is possible to perform correction in accordance with the changed sequential order.

A supplying section supplies the corrected signal portions to the data lines in accordance with the sequential order of the assignment performed by the assigning section. By this means, an electro-optical device is driven in a reliable manner.

As explained above, a driving device according to the first aspect of the invention described above corrects signal portions so as to reduce a difference in brightness of the display area of an electro-optical device. Therefore, if the configuration of a driving device according to the first aspect of the invention is adopted, it is possible to prevent the occurrence of flicker or other similar image problem, which is attributable to a change in the sequential order of the assignment of signal portions to data lines, while preventing the occurrence of display unevenness or other similar display failure due to a brightness difference. Thus, a driving device according to the first aspect of the invention described above makes it possible to display an image with high quality.

In the configuration of the device for driving an electro-optical device according to the first aspect of the invention described above, it is preferable that the changing section should supply a selection signal for selecting the sequential order to the assigning section and thereby should control the assigning section so that the sequential order should be changed.

In the preferred configuration of the driving device according to the first aspect of the invention described above, the changing section outputs a selection signal for selecting the sequential order of the assignment of each of the signal portions to the above-mentioned predetermined number of data lines that make up the corresponding group. The selection signal contains information that indicates, for example, the changed sequential order and the timing of change thereof, though not limited thereto. The changing section supplies such a selection signal to the assigning section. Upon the reception of the selection signal, the assigning section changes the sequential order. That is, the changing section controls the assigning section by means of the selection signal.

With the use of the selection signal, the sequential order of assignment performed by the assigning section is changed easily and without fail. Thus, the preferred configuration of a driving device explained above makes it possible to change the sequential order of the supply of signal portions to data lines in a preferable manner.

In the configuration of the device for driving an electro-optical device according to the first aspect of the invention described above, it is preferable that the correcting section should correct the gradations of the signal portions on the basis of the amount of correction that is set in accordance with the sequential order.

In the preferred configuration of the driving device according to the first aspect of the invention described above, the amount of correction, which is used as a basis for correcting the gradations of the signal portions, is set in accordance with the sequential order of the assignment of each of the signal portions to the above-mentioned predetermined number of data lines that make up the corresponding group. A set of plural correction amounts that corresponds to the sequential order is preset. For example, correction amount that is dedicated to the correction of the first-supplied signal portion, correction amount that is dedicated to the correction of the second-supplied signal portion, . . . , are preset. Typically, a set of correction amounts is predetermined in such a manner that the number thereof equals to the number of data lines that make up each data line group. These correction amounts are predetermined on the basis of the result of brightness-difference simulation, which has been performed in advance so as to simulate the luminance difference of the display area of an electro-optical device.

The correcting section corrects the gradations of the signal portions on the basis of the amount of correction that is set in accordance with the sequential order. For example, the correcting section adds a certain correction amount to the signal portion so as to perform correction. With such a preferred configuration, it is possible to correct signal portions in an easy manner.

In the preferred configuration of the driving device described above, according to which the correcting section corrects the gradations of the signal portions on the basis of the amount of correction that is set in accordance with the sequential order, it is further preferable that the correcting section should have a correction amount selecting section that selects the amount of correction in accordance with the sequential order; and the correcting section should correct the gradations of the signal portions on the basis of the selected amount of correction.

In such a preferred configuration, the correction amount selecting section selects the amount of correction that is used for correction. More specifically, the correction amount selecting section selects, among a plurality of preset correction amounts, one correction amount that is used for correction in accordance with the sequential order of the correction target signal portion. The correcting section corrects the signal portion on the basis of the selected correction amount. With such a preferred configuration, it is possible to correct the signal portion in an easier manner.

In the configuration of the device for driving an electro-optical device according to the first aspect of the invention described above, it is preferable that the changing section should change the sequential order of the assignment of each of the signal portions to the above-mentioned predetermined number of data lines that make up the corresponding group so as to reduce a difference in brightness in the display area of the electro-optical device, which is attributable to a change in the sequential order of the assignment of each of the signal portions to the above-mentioned predetermined number of data lines that make up the corresponding group.

In such a preferred configuration, the sequential order of the assignment of each of the signal portions to the above-mentioned predetermined number of data lines that make up the corresponding group is changed by the changing section so as to reduce a difference in brightness in the display area of the electro-optical device, which is attributable to a change in the sequential order of the assignment of each of the signal portions to the above-mentioned predetermined number of data lines that make up the corresponding group. That is, in addition to the reduction of a brightness difference that is achieved as a result of correction performed by the correcting section, with such a preferred configuration of a driving device, it is possible to achieve a further reduction in the brightness difference as a result of the changing of the sequential order performed by the changing section.

As has already been described above, the amount of brightness level change depends on the timing of the supply of the signal portions. For this reason, since the sequential order of the assignment of each of the signal portions to the above-mentioned predetermined number of data lines that make up the corresponding group is changed, it is possible to ensure that the amount of brightness level change at any region of the display area of an electro-optical device is not fixed. That is, if the sequential order of the assignment of signal portions to the data lines is changed with regularity, it is possible to achieve uniform brightness.

As explained above, since the sequential order of the assignment of each of the signal portions to the above-mentioned predetermined number of data lines that make up the corresponding group is changed by the changing section so as to reduce a difference in brightness in the display area of the electro-optical device, it is possible to further reduce a brightness difference. Thus, a driving device having a preferred configuration described above makes it possible to display an image with enhanced quality.

In the configuration of the device for driving an electro-optical device according to the first aspect of the invention described above, it is preferable that the changing section should change the sequential order of the assignment of each of the signal portions to the above-mentioned predetermined number of data lines that make up the corresponding group in accordance with a predetermined change rule.

In the preferred configuration of the driving device according to the first aspect of the invention described above, the changing section changes the sequential order in accordance with a predetermined change rule. Herein, the term "predetermined change rule" means, for example, a rule that achieves a reduction in the brightness difference in the display area of an electro-optical device. The predetermined change rule is set on the basis of the result of brightness-difference simulation, which has been performed in advance so as to simulate the luminance difference of the display area of an electro-optical device. Since the changing section changes the sequential order in accordance with such a predetermined change rule, it is possible to change the sequential order in an easier manner.

In the configuration of the device for driving an electro-optical device according to the first aspect of the invention described above, it is preferable that the changing section should change the sequential order of the assignment of each of the signal portions to the above-mentioned predetermined number of data lines that make up the corresponding group for each predetermined time period or for each set time period.

In the preferred configuration of the driving device according to the first aspect of the invention described above, the changing section changes the sequential order for each predetermined time period or for each set time period. Herein, the "predetermined time period or set time period" may be, for example, one horizontal scanning interval, which corresponds to a time period during which one horizontal scan operation is performed. Or, the predetermined time period (or set time period) may be one vertical scanning interval. The predetermined time period (or set time period) may be, for example, one frame time period during which one frame of an image is supplied in the display area of an electro-optical device. The predetermined time period (or set time period) may be, for example, one field time period during which one field of an image is supplied in the display area of an electro-optical device. The predetermined time period may be set in advance. Or, alternatively, the time period may be set on a real-time basis in accordance with an original non-corrected image signal that is to be supplied.

Since the changing section changes the sequential order for each predetermined time period or for each set time period, it is possible to periodically change the timing of supply of the signal portions to the data lines. Thus, the preferred configuration described above makes it possible to reduce a brightness difference in the display area of an electro-optical device.

In order to address the above-identified problem without any limitation thereto, the invention provides, as a second aspect thereof, a method for driving an electro-optical device, the driving method correcting an original non-corrected image signal that indicates an image that is to be displayed in a display area of the electro-optical device, the driving method supplying the corrected image signal to a plurality of data lines in the display area of the electro-optical device so as to drive the electro-optical device, the driving method including: (a) dividing the original non-corrected image signal into a plurality of non-corrected signal portions whose number corresponds to the number of groups of the data lines where each group thereof is made up of a predetermined number of data lines, and then outputting the signal portions; (b) assigning each of the signal portions to the above-mentioned predetermined number of data lines that make up the corresponding group, the assignment to the above-mentioned predetermined number of data lines being performed in a sequential manner; (c) changing the sequential order of the assignment of each of the signal portions to the above-mentioned predetermined number of data lines that make up the corresponding group; (d) correcting the gradations of the signal portions so as to reduce a difference in brightness in the display area of the electro-optical device, which is attributable to a change in the sequential order of the assignment of each of the signal portions to the above-mentioned predetermined number of data lines that make up the corresponding group; and (e) supplying the corrected signal portions to the data lines in accordance with the above-mentioned sequential order.

As done by a driving device according to the first aspect of the invention described above, in a driving method according to the second aspect of the invention, signal portions are corrected so as to reduce a difference in brightness of the display area of an electro-optical device. Therefore, if a driving method according to the second aspect of the invention is adopted, it is possible to prevent the occurrence of flicker or other similar image problem, which is attributable to a change in the sequential order of the assignment of signal portions to data lines, while preventing the occurrence of display unevenness or other similar display failure due to a brightness difference. Thus, a driving method according to the second aspect of the invention makes it possible to display an image with high quality.

Any of the preferred modes of the invention described above, which add restrictive features to the fundamental features of the driving device according to the first aspect of the invention, may be applied to the driving method according to the second aspect of the invention. If so applied, the driving method according to the second aspect of the invention that features any of the preferred modes of the invention offers the same operation/working effects as those of the preferred driving device according to the first aspect of the invention explained above.

In order to address the above-identified problem without any limitation thereto, the invention provides, as a third aspect thereof, an electro-optical device that is provided with a driving device according to the first aspect of the invention, which has any of the configurations described above, including its preferred or modified configurations.

Since an electro-optical device according to the third aspect of the invention is provided with a driving device according to the first aspect of the invention described above, it is possible to display an image with high quality.

In order to address the above-identified problem without any limitation thereto, the invention provides, as a fourth aspect thereof, an electronic apparatus that is provided with an electro-optical device according to the third aspect of the invention, which has any of the configurations described above, including its preferred or modified configurations.

According to an electronic apparatus of this aspect of the invention, it is possible to embody various kinds of electronic devices that are capable of providing a high-quality image display, including but not limited to, a projection-type display device, a television, a mobile phone, an electronic personal organizer, a word processor, a viewfinder-type video tape recorder, a direct-monitor-view-type video tape recorder, a workstation, a videophone, a POS terminal, a touch-panel device, and so forth, because the electronic apparatus of this aspect of the invention is provided with the electro-optical device according to the above-described aspect of the invention. In addition, as another non-limiting application example thereof, an electronic apparatus of this aspect of the invention may be also embodied as an electrophoresis apparatus such as a sheet of electronic paper.

These and other features, operations, and advantages of the present invention will be fully understood by referring to the following detailed description of exemplary embodiments in conjunction with the accompanying drawings.

BRIEF DESCRIPTION OF THE DRAWINGS

The invention will be described with reference to the accompanying drawings, wherein like numbers reference like elements.

FIG. 3 shows an example of the connection configuration thereof.

FIG. 5 shows one of a plurality of pixels thereof.

FIG. 10 is a matrix diagram that schematically illustrates an example of the sequential order of the assignment of signal portions, which is performed by a driving device according to an exemplary embodiment of the invention.

DESCRIPTION OF EXEMPLARY EMBODIMENTS

With reference to the accompanying drawings, exemplary embodiments of the present invention are described below.

Electro-Optical Device

Figure 1:
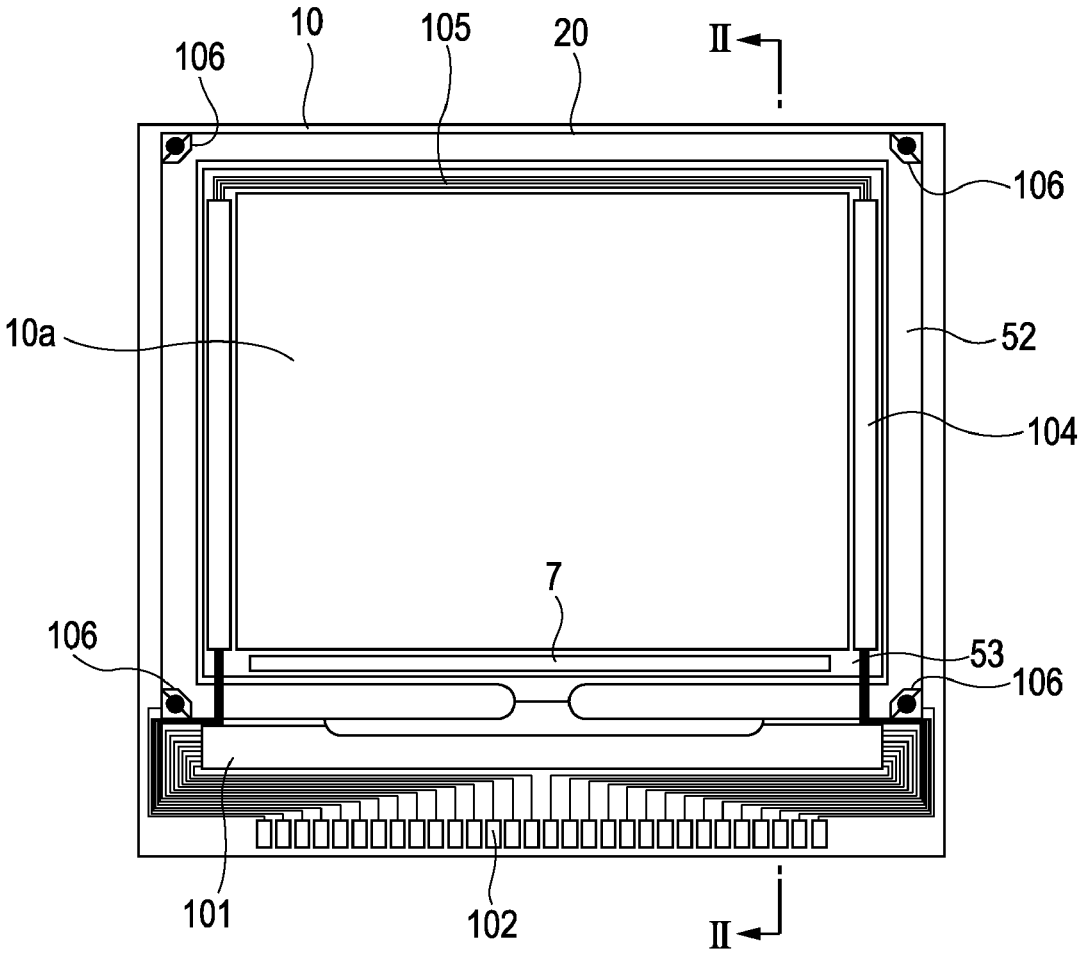
FIG. 1 is a plan view that schematically illustrates an example of the general configuration of a liquid crystal device according to an exemplary embodiment of the invention.
Figure 2:
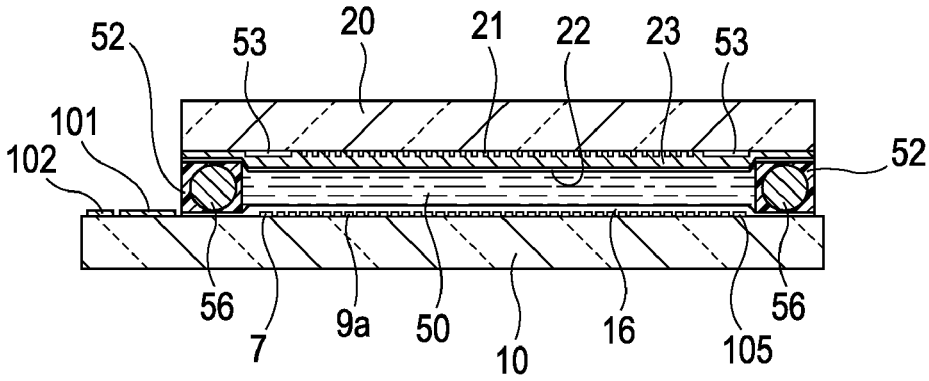
FIG. 2 is a sectional view taken along the line II-II of FIG. 1.
Figure 3:
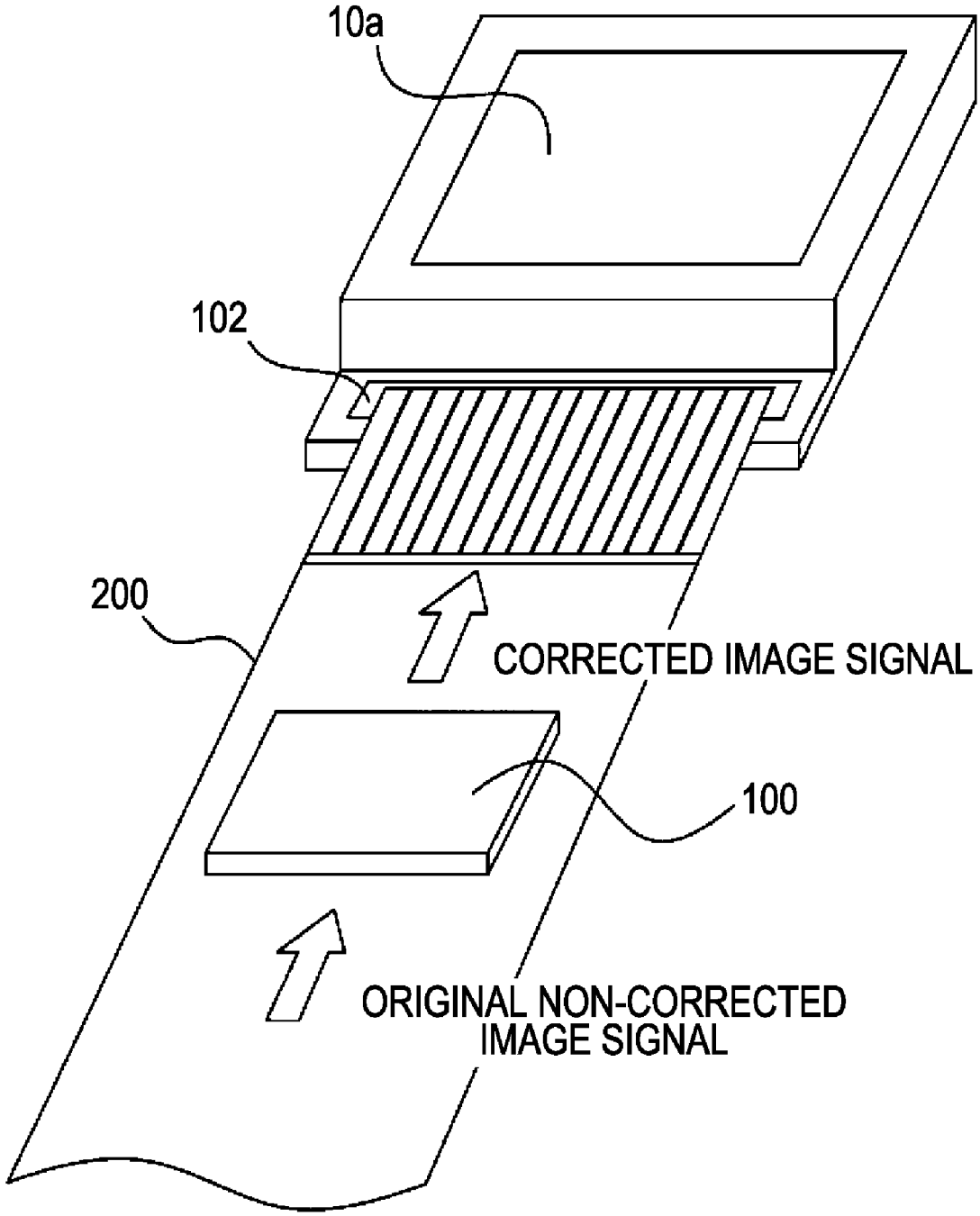
FIG. 3 is a perspective view that schematically illustrates an example of the general appearance of a driving device according to an exemplary embodiment of the invention and an electro-optical device driven by the driving device; more specifically.

First of all, an example of the configuration of an electro-optical device that is driven by a driving device (i.e., driver) according to an exemplary embodiment of the invention is explained while referring to FIGS. 1, 2, and 3. In the following description of an exemplary embodiment of the invention, a liquid crystal device that conforms to a thin-film-transistor (hereafter abbreviated as TFT) active-matrix driving scheme is taken as an example of various kinds of electro-optical devices to which a driving device according to an aspect of the invention can be applied. It is assumed that the liquid crystal device explained below is provided with a built-in driving circuit.

With reference to FIGS. 1 and 2, an explanation is given of an example of the general configuration of an electro-optical device (e.g., liquid crystal device) according to the present embodiment of the invention. FIG. 1 is a plan view that schematically illustrates an example of the configuration of a liquid crystal device according to the present embodiment of the invention. FIG. 2 is a sectional view taken along the line II-II of FIG. 1.

As shown in FIGS. 1 and 2, in the configuration of a liquid crystal device according to the present embodiment of the invention, a TFT array substrate 10 and a counter substrate 20 are provided opposite to each other. The TFT array substrate 10 is configured as a transparent substrate that is made of, for example, a quartz substrate, a glass substrate, a silicon substrate, or the like. The counter substrate (i.e., opposite substrate) 20 is also formed as a transparent substrate. A liquid crystal layer 50 is sealed between the TFT array substrate 10 and the counter substrate 20. The TFT array substrate 10 and the counter substrate 20 are bonded to each other with the use of a sealant material 52 that is provided at a sealing region (i.e., sealing area) around an image display region (i.e., image display area) 10*a*. A plurality of pixel electrodes is provided in the image display region 10*a*. The image display region 10*a* described herein is a non-limiting example of a "display area" according to an aspect of the invention.

The sealant material 52 is made from, for example, an ultraviolet (UV) curable resin, a thermosetting resin, or the like, which functions to paste these substrates together. In the production process of the liquid crystal device according to the present embodiment of the invention, the sealant material 52 is applied onto the TFT array substrate 10 and subsequently hardened through ultraviolet irradiation treatment, heat treatment, or any other appropriate treatment. A gap material such as glass fibers, glass beads, or the like, are scattered in the sealant material 52 so as to set the distance (i.e., inter-substrate gap) between the TFT array substrate 10 and the counter substrate 20 at a predetermined gap value.

Inside the sealing area at which the sealant material 52 is provided, and in parallel therewith, a picture frame light-shielding film 53, which has light-shielding property and defines the picture frame region of the image display area 10*a*, is provided on the counter substrate 20. Notwithstanding the above, however, a part or a whole of the picture frame light-shielding film 53 may be provided at the TFT-array-substrate (10) side as a built-in light-shielding film.

A driving circuit (e.g., data line driving circuit, though not limited thereto) 101 and external circuit connection terminals 102 are provided at a certain peripheral region outside the sealing region at which the sealant material 52 is provided in such a manner that these driving circuit 101 and external circuit connection terminals 102 are provided along one of four sides of the TFT array substrate 10. A pair of scanning line driving circuits 104 is provided along two of four sides thereof that are not in parallel with the above-mentioned one side in such a manner that each of the scanning line driving circuits 104 is covered by the picture frame light-shielding film 53. In addition to the above, a plurality of electric wirings 105 is provided along the remaining one side of the TFT array substrate 10 that is parallel with the first-mentioned one side thereof. The plurality of electric wirings 105 connects one of the pair of the scanning line driving circuits 104 to the other thereof. The picture frame light-shielding film 53 covers these electric wirings 105. The pair of the scanning line driving circuits 104 is provided outside the image display region 10*a* in such a manner that each of these scanning line driving circuits 104 extends along the corresponding one of the second-mentioned two sides thereof.

Inter-substrate conductive terminals 106, which connect the TFT array substrate 10 with the counter substrate 20 by means of inter-substrate conductive material 107, are provided on the TFT array substrate 10 at positions corresponding to four corners of the counter substrate 20, respectively. With such a structure, it is possible to establish electric conduction between the TFT array substrate 10 and the counter substrate 20.

As illustrated in FIG. 2, a layered structure (i.e., lamination structure) that includes laminations of TFTs for pixel switching, which are driving/driver elements, and of wirings/lines such as scanning lines, data lines, and the like is formed on the TFT array substrate 10. Pixel electrodes 9*a* are formed at a layer above the lamination structure described above. An orientation film (i.e., alignment film) is deposited on the pixel electrodes 9*a*. Each of the pixel electrodes 9*a* is configured as a transparent electrode, which is made of a transparent (electro-) conductive material such as indium tin oxide (ITO) or the like. The alignment film (i.e., orientation film) is made of an organic film such as a polyimide film or the like. On the other hand, a light-shielding film 23 that has either a grid pattern or a striped pattern is formed on the inner surface of the counter substrate 20. A counter electrode 21 is formed over the entire inner surface of the light-shielded counter substrate 20. An orientation film is formed as the uppermost layer of a lamination structure formed on the counter substrate 20. The counter electrode 21 is made of a transparent electro-conductive material such as indium tin oxide (ITO) or the like. The alignment film is made of an organic film such as a polyimide film or the like. The TFT array substrate 10 and the counter substrate 20 are adhered to each other so that the pixel electrodes 9*a* formed on the TFT array substrate 10 and the counter electrode 21 formed on the counter substrate 20 face (i.e., are provided opposite to) each other. In addition to these layer constituent elements described above, an electro-optical device according to the present embodiment of the invention further has the liquid crystal layer 50. The liquid crystal layer 50 is formed between the TFT array substrate 10 and the counter substrate 20. The liquid crystal layer 50 is made of liquid crystal that consists of, for example, a mixture of one or more types of nematic liquid crystal element. Such liquid crystal takes a predetermined orientation state between a pair of the above orientation films (i.e., alignment films).

It should be noted that other functional circuits may be provided on the TFT array substrate 10 illustrated in FIGS. 1 and 2 in addition to the above-described (data line) driving circuit 101 and the scanning line driving circuit 104, and the like, including but not limited to, a sampling circuit that performs the sampling of an image signal that flows on an image signal line so as to supply the sampled signal to a data line, a pre-charge circuit that supplies a pre-charge signal having a predetermined voltage level to each of the plurality of data lines prior to the supplying of an image signal, a test circuit for conducting an inspection on the quality, defects, etc., of the electro-optical device during the production process or before shipment, and the like.

Driving Device

Next, with reference to FIGS. 3-12, the configuration of a driving device according to the present embodiment of the invention as well as the operation thereof, which drives an electro-optical device having the configuration described above, is explained below.

First of all, a general view of a driving device according to the present embodiment of the invention and an electro-optical device described above, which are connected to each other, is explained as a non-limiting example thereof while referring to FIG. 3. FIG. 3 is a perspective view that schematically illustrates an example of the general appearance of a driving device according to the present embodiment of the invention and an electro-optical device driven by the driving device according to the present embodiment of the invention; more specifically, FIG. 3 shows an example of the connection configuration thereof.

A driving device 100 according to the present embodiment of the invention, which is shown in FIG. 3, supplies a corrected image signal to the aforementioned driving circuit 101 of an electro-optical device, which is shown in FIGS. 1 and 2, in a predetermined signal format. The corrected image signal is an image signal that has been subjected to correction processing. In addition, the driving device 100 according to the present embodiment of the invention supplies a control signal to the driving circuit 101 for the purpose of controlling the timing of the supply of the corrected image signal and further controlling the order of the supply thereof. More specifically, the driving device 100 is provided on a flexible printed wiring board 200. The flexible printed wiring board 200 is electrically connected to the aforementioned external circuit connection terminals 102 of the electro-optical device. Because of such a discrete structure, the driving device 100 according to the present embodiment of the invention is provided as an external circuit or an external driver, which is separated from the liquid crystal panel of the electro-optical device (e.g., liquid crystal display device). That is, in the illustrated connection example thereof, the driving device 100 according to the present embodiment of the invention is provided as an image signal supply device or an image signal supply circuit, which supplies corrected image signals to the liquid crystal panel of the electro-optical device from the outside. Or, as a non-limiting example of a variety of modified configurations thereof, the driving device 100 according to the present embodiment of the invention may be provided as an image signal correction device or an image signal correction circuit, which is formed as a built-in circuit component of an original image signal supply device (or circuit), which supplies an original image signal, which has not been subjected to correction processing yet, to the built-in correction device (or circuit) 100. The above-explained modified configuration may be further modified in such a manner that the driving device 100 according to the present embodiment of the invention that is configured as an image signal correction device or an image signal correction circuit is provided at a downstream position of a signal processing flow when viewed from the original image signal supply device (or circuit). If so modified, an original non-corrected image signal that is outputted from the original image signal supply device (or circuit) is corrected at the downstream correction device (or circuit) 100. Or, as another non-limiting example of a variety of modified configurations thereof, the driving device 100 according to the present embodiment of the invention may be provided not as an external circuit or an external driver, which is separated from the liquid crystal panel of the electro-optical device, but as an internal circuit or an internal driver, which is a built-in circuit component of the electro-optical device. In such a modified configuration, the driving device 100 formed as a built-in circuit component of the electro-optical device may include the aforementioned driving circuit (e.g., data line driving circuit, though not limited thereto) 101 and/or the aforementioned scanning line driving circuit 104, and the like. Note that the driving device 100 according to the present embodiment of the invention may perform various kinds of processing known in the art such as gamma correction and serial/parallel conversion, though not limited thereto, in addition to the unique correction of an aspect of the invention. A more detailed explanation of the unique correction according to an exemplary embodiment of the invention will be given later.

Figure 4:
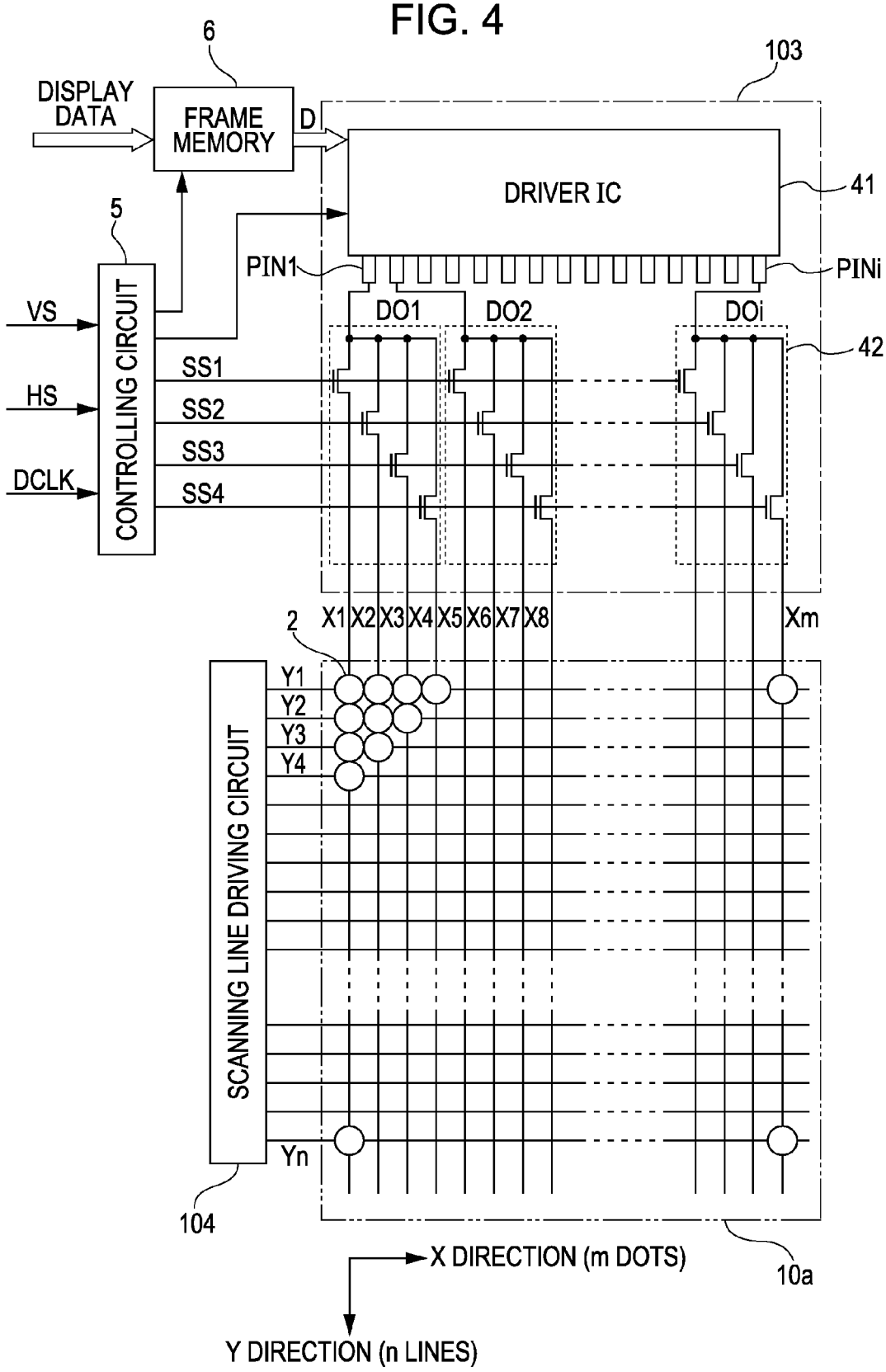
FIG. 4 is a block diagram that schematically illustrates an example of the configuration of a driving device according to an exemplary embodiment of the invention, which is shown together with the configuration of an electro-optical device that is driven by the driving device.
Figure 5:
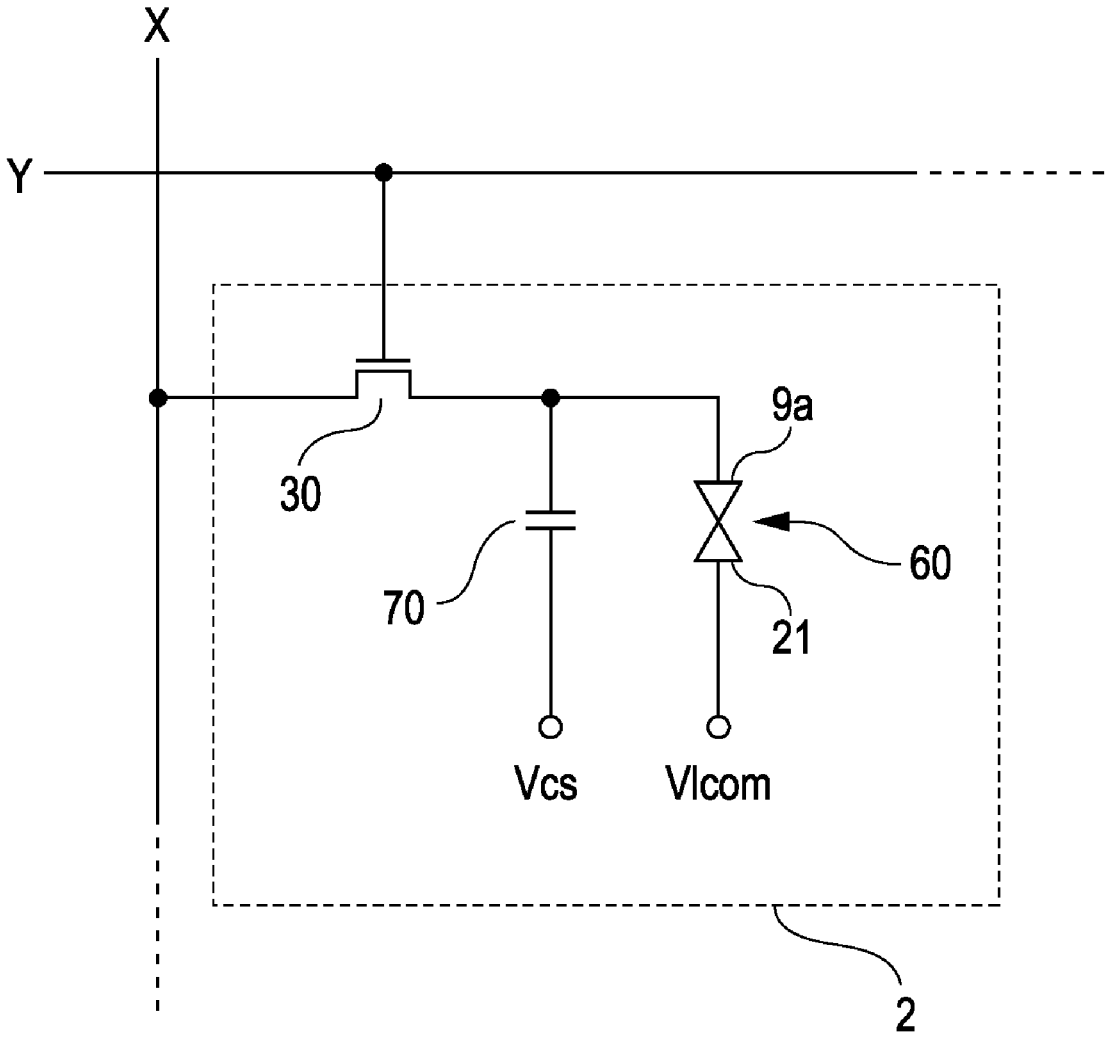
FIG. 5 is an equivalent circuit diagram that schematically illustrates an example of the pixel configuration of an electro-optical device that is driven by a driving device according to an exemplary embodiment of the invention; more specifically.
Figure 6:
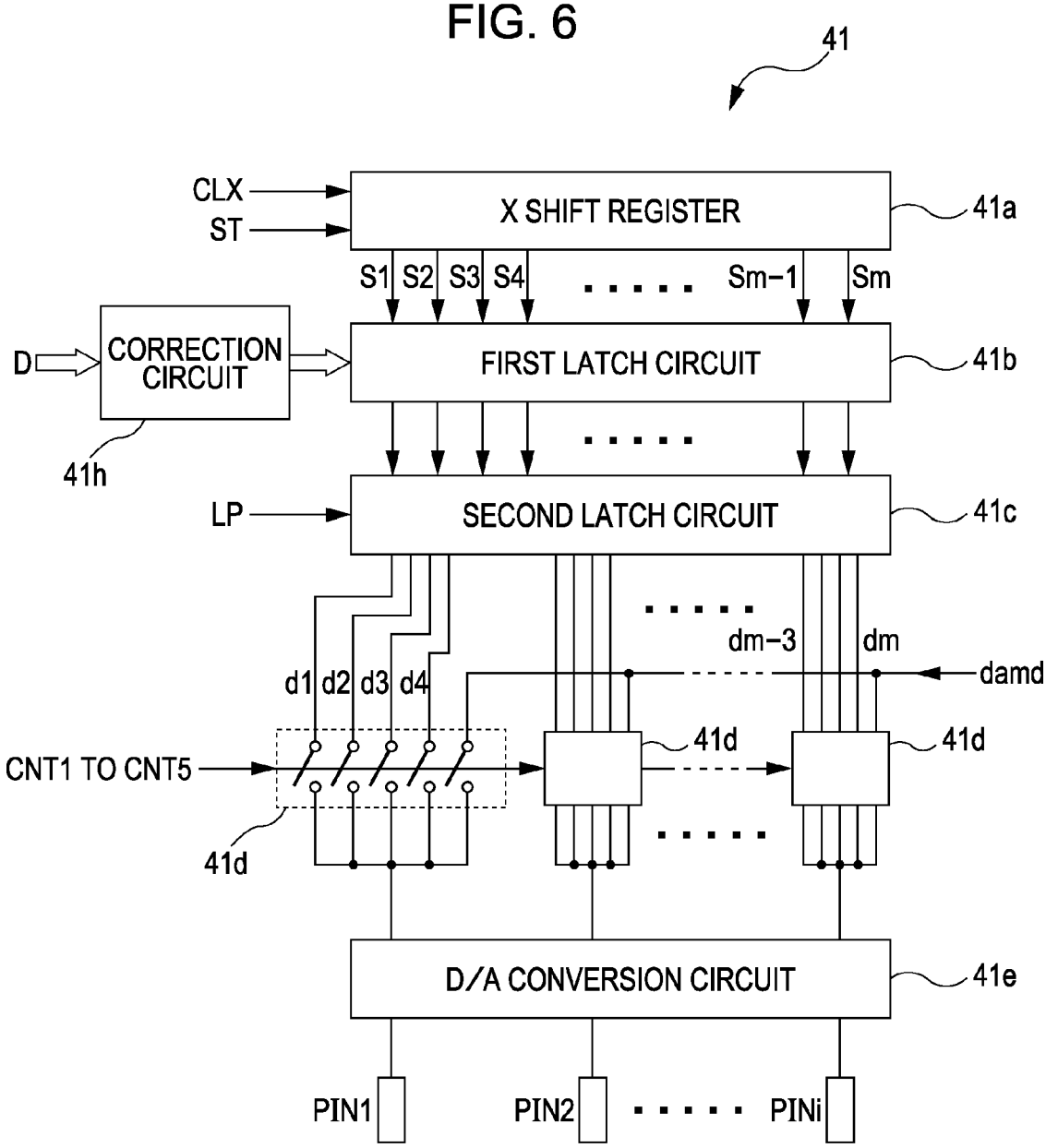
FIG. 6 is a block diagram that schematically illustrates an example of the configuration of a driver IC (First Example).
Figure 7:
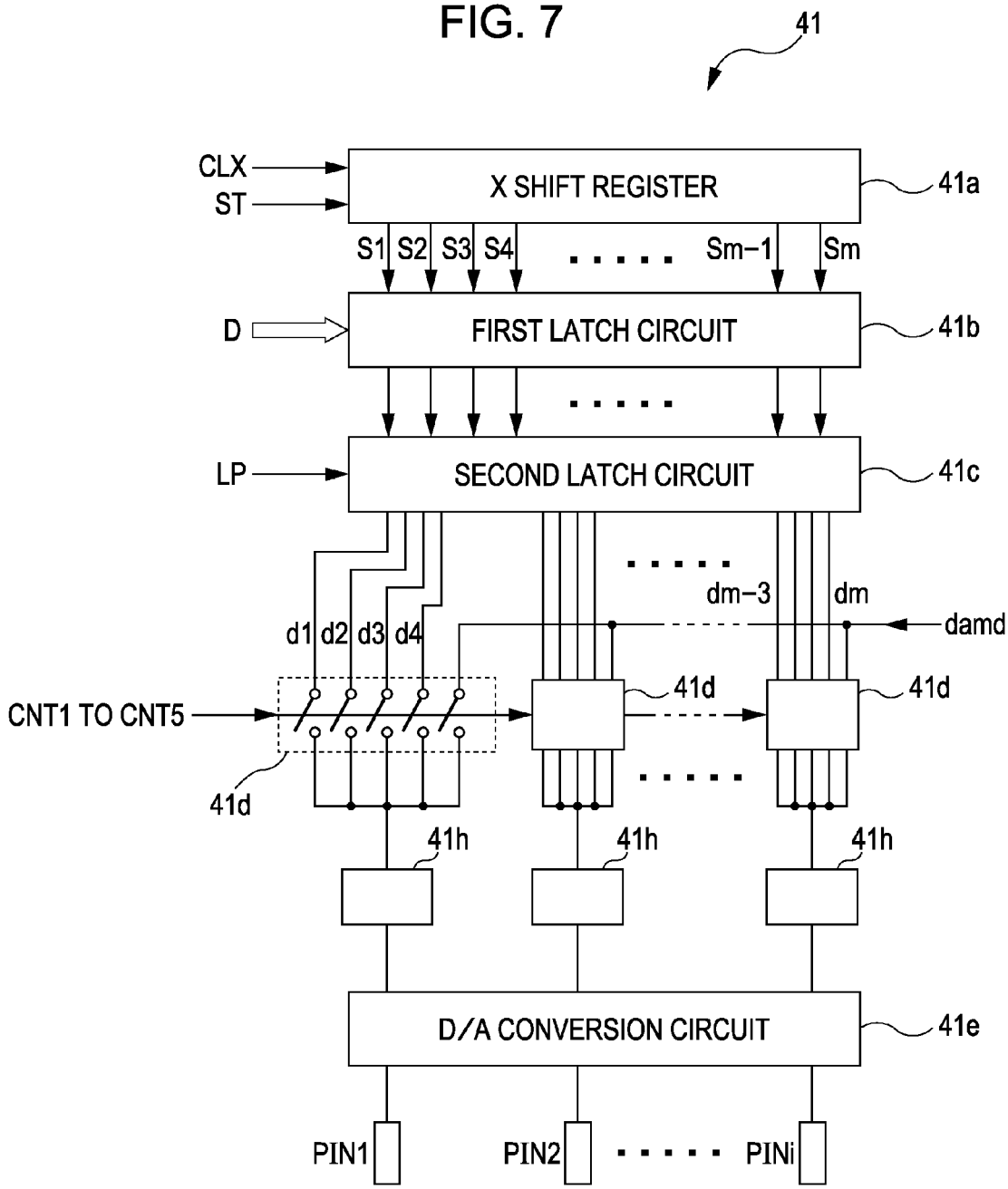
FIG. 7 is a block diagram that schematically illustrates another example of the configuration of a driver IC (Second Example).

Next, with reference to FIGS. 4-7, the electric configuration of the driving device 100 according to the present embodiment of the invention is explained. FIG. 4 is a block diagram that schematically illustrates an example of the configuration of the driving device 100 according to the present embodiment of the invention, which is shown together with the configuration of an electro-optical device that is driven by the driving device 100. FIG. 5 is an equivalent circuit diagram that schematically illustrates an example of the pixel configuration of a liquid crystal device (electro-optical device) that is driven by the driving device 100 according to the present embodiment of the invention; more specifically, FIG. 5 shows one of a plurality of pixels thereof. FIG. 6 is a block diagram that schematically illustrates an example of the configuration of a driver IC (First Example). FIG. 7 is a block diagram that schematically illustrates another example of the configuration of a driver IC (Second Example). In the following description of this specification as well as in the illustration of the accompanying drawings, it is assumed that each data line group consists of four data lines X.

As shown in FIG. 4, a plurality of pixels 2 is arrayed in the image display area 10*a* in such a manner that they form a matrix pattern, which is a two-dimensional layout. The matrix has "m" number of dots (i.e., columns) and "n" number of lines (i.e., rows). That is, the plurality of pixels 2 is arrayed so as to form a two-dimensional "m×n" layout pattern. In addition to these matrix-arrayed pixels 2, n number of scanning lines Y1, Y2, Y3, . . . , Yn and m number of data lines X1, X2, X3, . . . , Xm are formed in the image display area 10*a*. Each of the scanning lines Y1-Yn extends along the corresponding row, that is, in the X direction. In other words, these scanning lines Y1-Yn are arrayed adjacent to one another when viewed in the Y direction. On the other hand, each of the data lines X1-Xm extends along the corresponding column, that is, in the Y direction. In other words, these data lines X1-Xm are arrayed adjacent to one another when viewed in the X direction. The pixel 2 is formed at a position corresponding to each intersection of these scanning lines Y1-Yn and data lines X1-Xm.

Referring to FIG. 5, the circuit configuration of the pixel 2 is explained below. Each of the plurality of pixels 2 is made up of a TFT 30, a liquid crystal capacitor (i.e., liquid crystal capacitance) 60, and a storage capacitor 70. The TFT 30 functions as a pixel-switching element. The source electrode (i.e., source terminal) of the TFT 30 is electrically connected to one data line X. The gate electrode (i.e., gate terminal) of the TFT 30 is electrically connected to one scanning line Y. The source electrode of the TFT 30 of each of n pixels 2 that are aligned so as to form one column is "common-connected" to the same single data line X. That is, the source electrode of the TFT 30 of arbitrary one of n pixels 2 that are aligned so as to form one column is electrically connected to one data line X (that is the same as the line) to which the source electrode of the TFT 30 of any other of the above-mentioned n pixels 2 of the same column is connected. The same holds true for each of m columns. The gate electrode of the TFT 30 of each of m pixels 2 that are aligned so as to form one row is common-connected to the same single scanning line Y. That is, the gate electrode of the TFT 30 of arbitrary one of m pixels 2 that are aligned so as to form one row is electrically connected to one scanning line Y (that is the same as the line) to which the gate electrode of the TFT 30 of any other of the above-mentioned m pixels 2 of the same row is connected. The same holds true for each of n rows. The drain electrode of the TFT 30 is electrically connected to both of the liquid crystal capacitor 60 and the storage capacitor 70. That is, the liquid crystal capacitor 60 and the storage capacitor 70 are connected, in electrically parallel with each other, to the drain terminal of the TFT 30. The liquid crystal capacitor 60 is made up of a pixel electrode 9*a*, a counter electrode 21, and liquid crystal. The liquid crystal is sandwiched between the pixel electrode 9*a* and the counter electrode 21. The storage capacitor 70 is formed between the pixel electrode 9*a* and a common capacitor electrode, the latter of which is not shown in the drawing. A voltage Vcs is applied to the storage capacitor 70. The storage capacitor 70 prevents or at least reduces the leakage of electric charges accumulated in the liquid crystal. A data voltage or the like is applied to the pixel-electrode (9*a*) side. The liquid crystal capacitor 60 and the storage capacitor 70 are charged/discharged in accordance with the level of the voltage applied thereto. The optical transmittance (i.e., light transmission factor) of the liquid crystal is determined in accordance with a difference between the electric potential of the pixel electrode 9*a* and the electric potential of the counter electrode 21, that is, the voltage applied to the liquid crystal. By this means, the gradation of the pixel 2 is determined.

Referring back to FIG. 4, an explanation of the driving device 100 according to the present embodiment of the invention and an electro-optical device that is driven by the driving device 100 is further continued. In order to extend the service life of liquid crystal, the pixels 2 are driven in an AC (Alternating Current) driving method according to which voltage polarity is reversed at each lapse of a predetermined time period. The voltage polarity is determined on the basis of the direction of an electric field that is applied to a liquid crystal layer. In other words, the voltage polarity depends on whether a voltage applied to a liquid crystal layer is positive or negative. In the present embodiment of the invention, a common DC driving method, which is an example of a variety of AC driving methods, is used for driving the pixels 2. Accordingly, both of a voltage Vlcom, which is applied to the counter electrode 21, and a voltage Vcs, which is applied to the aforementioned common capacitor electrode, are maintained at a constant value, whereas polarity at the pixel-electrode (9*a*) side is reversed.

External signals such as a vertical synchronization signal (hereafter simply referred to as "vertical sync signal") VS, a horizontal synchronization signal (hereafter simply referred to as "horizontal sync signal") HS, a dot clock signal DCLK, and the like are inputted into a controlling circuit 5 from a host apparatus. The host apparatus is an upper-level apparatus, which is not shown in the drawing. On the basis of these external signals, the controlling circuit 5 performs synchronous control on the aforementioned scanning line driving circuit 104, a data line driving circuit 103, and a frame memory 6. Under the synchronous control of the controlling circuit 5, the scanning line driving circuit 104 and the data line driving circuit 103 co-operate with each other so as to perform display control in the image display region 10*a*. In the present embodiment of the invention, a driving speed is heightened in order to avoid the problem of flickers. Specifically, a double-speed driving scheme is adopted. In the double-speed driving scheme, a refresh rate is set at 120 Hz, which is twice as fast as normal rate. Accordingly, vertical sync frequency of the present embodiment of the invention is set at twice as high as that of normal frequency. Under such a double-speed driving scheme, each one frame (that is, 1/60 sec) that is defined by the vertical sync signal VS is made up of two fields. Therefore, line sequential scanning is performed twice in each frame.

The scanning line driving circuit 104 is mainly made up of, though not limited thereto, a shift register and an output circuit. The scanning line driving circuit 104 outputs scanning signals SEL to the scanning lines Y1-Yn so as to sequentially select the scanning lines Y1-Yn. The sequential selection is performed in the unit of a horizontal scanning interval, which corresponds to a time period during which one scanning line Y is selected. One horizontal scanning interval is hereafter abbreviated as "1H". The scanning signal SEL is set at either one of binary values. That is, the scanning signal SEL is set at either a high voltage level (hereafter referred to as "H level") or a low voltage level (hereafter referred to as "L level"). At each selection, one scanning line Y that corresponds to the data-writing target row of pixels 2 is set at the H level, whereas other scanning lines Y are set at the L level. The data-writing target row of pixels 2 is selected one after another as a result of the level setting of the scanning signals SEL described above. Data that has been written in the target row of pixels 2 is kept for the duration (i.e., time period) of one field.

The frame memory 6 has a memory space of at least m×n bits. The m×n memory area of the frame memory 6 corresponds to the resolution of the image display area 10*a*. Display data is inputted from an upper-level host apparatus into the frame memory 6. The frame memory 6 stores and memorizes, on a frame-by-frame basis, the display data that is inputted from the upper-level host apparatus. Note that the upper-level host apparatus is not shown in the drawing. The controlling circuit 5 controls the writing of display data into the frame memory 6 and the reading of the stored data out of the frame memory 6. In the following description of this specification, it is assumed that display data D, which specifies the gradation of the pixels 2, is 64-scales data that is made up of six bits D0, D1, D2, D3, D4, and D5. It should be noted that the bit configuration of the display data D and the scales/gradations thereof are not limited to the specific example described above. The display data D that has been read out of the frame memory 6 is then transferred as serial data to the data line driving circuit 103 via a 6-bit bus.

The data line driving circuit 103 is provided at a downstream position of a signal processing flow as viewed from the frame memory 6. The data line driving circuit 103 co-operates with the scanning line driving circuit 104 so as to output, to the data lines X1-Xm, data that should be supplied to the data-writing target row of pixels 2. The data line driving circuit 103 is made up of a driver IC 41 and a time division circuit 42. The driver IC 41 is formed as a discrete driver, which is separated from the display panel that has a matrix array of the plurality of pixels 2 formed therein. The driver IC 41 has "i" number of output pins PIN1, PIN2, PIN3, . . . , PINi. These output pins PIN1, PIN2, PIN3, . . . , PINi are connected to the same number of output lines DO1, DO2, DO3, . . . , DOi, respectively. In order to reduce cost of production, the time division circuit 42 is provided as a built-in circuit component of the display panel. The time division circuit 42 is made of a polysilicon TFT and the like. That is, the driver IC is provided as a component of the driving device 100 according to the present embodiment of the invention, which is shown in FIG. 3. On the other hand, the time division circuit 42 is provided as a component of the aforementioned driving circuit 101 of an electro-optical device, which is shown in FIGS. 1 and 2. It should be noted that the scope of the invention is not limited to the specific exemplary configuration explained above. As a non-limiting modification example thereof, the driver IC 41 may be formed not as a discrete driver that is separated from the display panel but as a built-in circuit component of the display panel. As another non-limiting modification example thereof, the time division circuit 42 (and/or the scanning line driving circuit 104 or the like) may be provided not as a built-in circuit component of the display panel but as an external component that is separated from the display panel. As still another non-limiting modification example thereof, the driver IC 41 may be formed as a single integrated circuit that includes the entire or partial function of the controlling circuit 5 and/or the entire or partial function of the frame memory 6.

The driver IC 41 outputs data for the current data-writing target row of pixels 2 and latches (i.e., holds) data for the next data-writing target row of pixels 2 in a dot sequential manner. The driver IC performs the above-described outputting of data for the current data-writing target row of pixels 2 and the above-described dot-sequential latching of data for the next data-writing target row of pixels 2 at the same time. In addition, the driver IC 41 corrects the gradations of data. The configuration and operation of the driver IC 41 is explained in detail below.

As shown in FIG. 6, the driver IC 41 is mainly made up of the following inner circuit components: an X shift register 41*a*, a first latch circuit 41*b*, a second latch circuit 41*c*, a group of selection switches 41*d*, a D/A conversion circuit 41*e*, and a correction circuit 41*h*. The X shift register 41*a* transfers a start signal ST, which is supplied at the start of 1H, in accordance with a clock signal CLX. The X shift register 41*a* sets one of latch signals S1, S2, S3, . . . , Sm at the H level while setting others at the L level.

The display data D that is inputted into the driver IC 41 enters the correction circuit 41*h* before it enters the first latch circuit 41*b*. The correction circuit 41*h* described herein is a non-limiting example of a "correcting section" according to an aspect of the invention. The correction circuit 41*h* adds a certain correction amount to the display data D. The amount of correction added by the correction circuit 41*h* depends on the sequential order of the supply of the display data D to the data lines X. A more detailed explanation of the correction performed by the correction circuit 41*h* will be given later.

The first latch circuit 41*b* latches m-number of 6-bit data D, which are supplied as serial data, in a sequential manner. The first latch circuit 41*b* performs such sequential latching at the time of the falling of the latch signal S1, S2, S3, . . . , Sm. The second latch circuit 41*c* latches the data D that have been latched at the first latch circuit 41*b* concurrently at the time of the falling of a latch pulse LP. The latched m-number of data D are outputted from the second latch circuit 41*c* in a parallel manner in the next 1H in the form of data signals d1, d2, d3, . . . , dm, which are digital data.

The plurality of selection switches 41*d* whose number equals to "i" puts the data signals d1, d2, d3, . . . , dm into a plurality of time-series data groups. Since it is assumed in the description of this specification as well as in the illustration of the accompanying drawings that each data line group consists of four data lines X as explained earlier, the data signals d1, d2, d3, . . . , dm are grouped into time-series data where each group thereof corresponds to four pixels 2. Each of the i-number of the selection switches 41*d* is provided for four data lines X. Accordingly, the "i" number of the selection switches 41*d* is equal to "m divided by four" (i=m/4). In the accompanying drawings, each of the selection switches 41*d* is shown as a set of five switches in order to simplify illustration. However, in a practical sense, each of the selection switches 41*d* has not five switches but five sets of switches. Each of five sets of switches includes six switches corresponding to six bits. In other words, each of five switches shown in the accompanying drawings represents not a single switch but six switches corresponding to six bits. All of these six switches that belong to the same bit set always behave in the same way as one another. For this reason, in the description of this specification as well as in the illustration of the accompanying drawings, these six switches that belong to the same bit set is regarded as one switch for simplicity's sake.

A group of data signals corresponding to four pixels 2, which is outputted from the second latch circuit 41*c*, is inputted into each of the groups of selection switches 41*d*. For example, a group of data signals d1, d2, d3, and d4 is inputted into the leftmost selection switch 41*d* in the illustrated example. In addition to these four data signals, correction data "damd" is also inputted into each of the groups of selection switches 41*d*. Herein, the correction data damd is digital data that determines the voltage level of a pre-charge voltage. Five control signals CNT1-CNT5 control the conduction of five switches that make up the selection switch 41*d*. These five switches are turned ON in a selective and sequential manner with offset timing As a result thereof, the correction data (damd) and the group of data signals (e.g., d1, d2, d3, and d4) are put into time-series data in the sequential order of appearance herein (i.e., damd, d1, d2, d3, and d4) during 1H. Then, these time-series data are outputted from the selection switch 41*d*. That is, with the use of these control signals CNT1-

CNT5, it is possible to permute the data signals d1, d2, d3, . . . , dm. In other words, with the use of these control signals CNT1-CNT5, it is possible to change the sequential order of the data signals d1, d2, d3, . . . , dm. It should be noted that, even when the sequential order of assignment of the data signals d1, d2, d3, . . . , dm are changed, the correspondence (i.e., corresponding relationship) between the data signals d1, d2, d3, . . . , dm and the data lines X1, X2, X3, . . . , Xm is maintained without any change. That is, it is the sequential order of the supply of the data signals d1-dm to the data lines X that is subjected to change when the sequential order of assignment of the data signals d1, d2, d3, . . . , dm are changed. It is not the correspondence between the data signals d1, d2, d3, . . . , dm and the data lines X1, X2, X3, . . . , Xm that is subjected to change when the sequential order of assignment of the data signals d1, d2, d3, . . . , dm are changed. Thus, even when the sequential order of assignment of the data signals d1, d2, d3, . . . , dm are changed, each of the data signals d1, d2, d3, . . . , dm is supplied to the corresponding data line X.

As shown in FIG. 7, the correction circuit 41*h* explained above may be provided at a downstream position of a signal processing flow as viewed from the selection switch 41*h*. That is, correction may be performed after the grouping of the data signals d1, d2, d3, . . . , dm. If such a modified configuration is adopted, the correction circuit 41*h* is provided for each of the plurality of selection switches 41*d*. As explained above, the execution timing of correction processing is not specifically limited. Correction may be performed at any point in time other than those explained above as long as it is performed prior to the supply thereof to the data lines X.

The digital-to-analog conversion circuit 41*e*, which is herein abbreviated as D/A conversion circuit 41*e*, performs D/A conversion processing. Specifically, the D/A conversion circuit 41*e* converts a series of digital data that is outputted from the selection switches 41*d* into analog data. As a result of the D/A conversion processing performed by the D/A converter 41*e*, the correction data damd is converted into a pre-charge voltage. On the other hand, the data signals d1, d2, d3, . . . , dm that are "time-series grouped" in the unit of four pixels are converted into data voltages as a result of the D/A conversion processing performed by the D/A converter 41*e*. The converted data voltages are outputted from the output pins PIN1, PIN2, PIN3, . . . , PINi in time series.

As has already been explained earlier while referring to FIG. 4, the output pins PIN1, PIN2, PIN3, . . . , PINi of the driver IC 41 are connected to the same number of the aforementioned output lines DO1, DO2, DO3, . . . , DOi, respectively. Each of these output lines DO1, DO2, DO3, . . . , DOi corresponds to a group of four data lines X arrayed adjacent to one another. The time division circuit 42 is provided between each of the plurality (i.e., i number) of output lines DO and the corresponding group of four data lines X. That is, one time division circuit 42 is provided for each of these output lines DO1, DO2, DO3, . . . , DOi. Each group of four data lines X (e.g., X1, X2, X3, and X4) described herein is a non-limiting example of a "data line group" according to an aspect of the invention. In other words, each of these output lines DO1, DO2, DO3, . . . , DOi corresponds to the data line group according to an aspect of the invention.

Each time division circuit 42 has a plurality of selection switches, the number of which corresponds to the number of data lines X that make up a group. Since it is assumed in the description of this specification as well as in the illustration of the accompanying drawings that each data line group consists of four data lines X as explained earlier, each time division circuit 42 has four selection switches. The controlling circuit 5 sends selection signals SS1, SS2, SS3, and SS4 to each of the time division circuits 42. These selection signals SS1-SS4 control the conduction of four selection switches of each time division circuit 42. The selection signals SS1-SS4 determine the switch ON time periods of four selection switches that belong to the same group. The selection signals SS1-SS4 are in synchronization with time-series signal output from the IC driver 41. That is, at this processing stage, the data signals d1, d2, d3, . . . , dm are assigned to the data lines X1, X2, X3, . . . , Xm, respectively, in accordance with the sequential order of the output from the selection switches 41*d* of the driver IC 41. All of these i number of time division circuits 42 have the same configuration. In addition, all of them operate concurrently.

As explained above, the data signals d1, d2, d3, . . . , dm are supplied to the data lines X1, X2, X3, . . . , Xm, respectively, after the controlling of the sequential order of the supply thereof and after the correction of gradations thereof.

Figure 8:
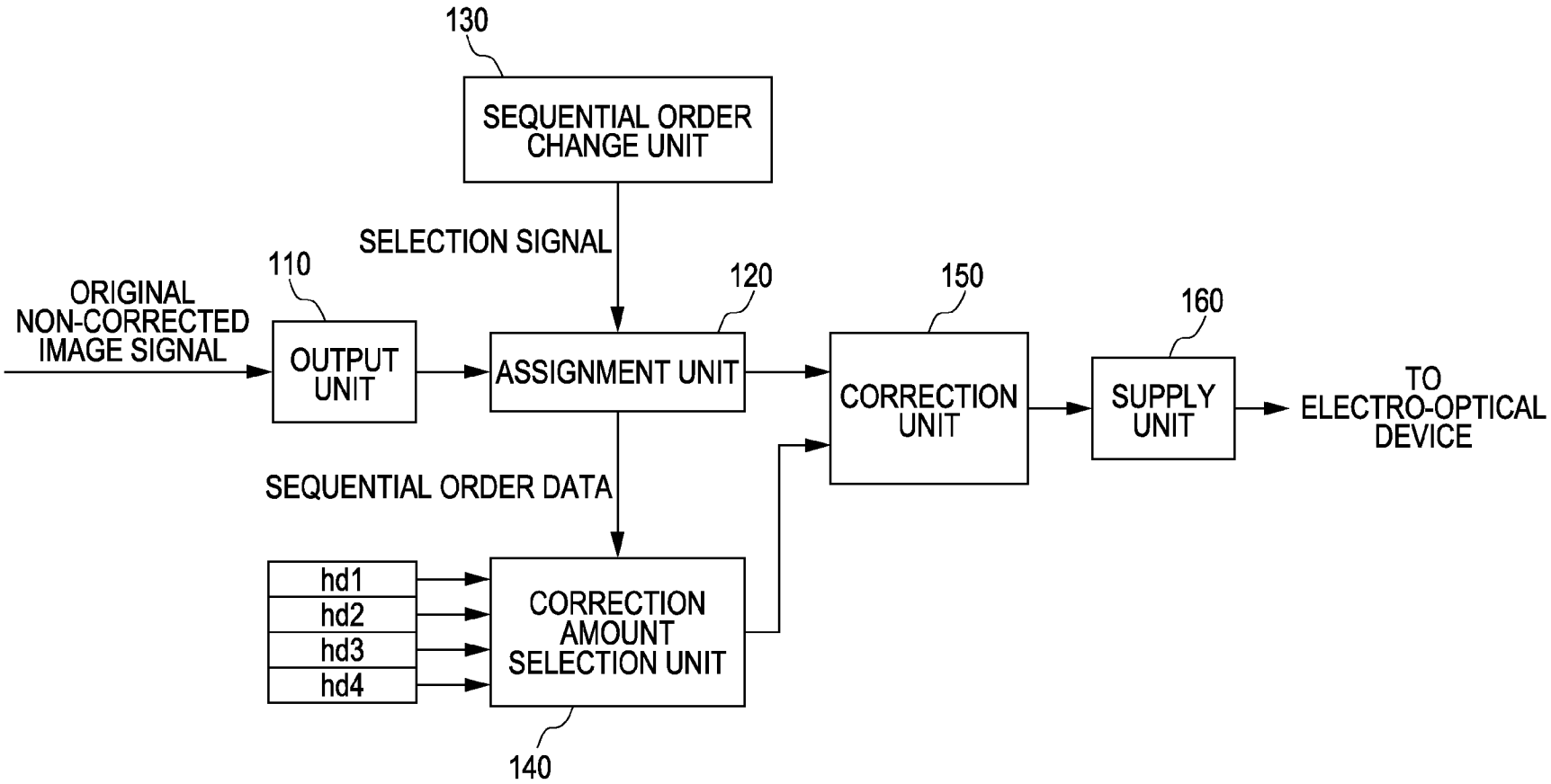
FIG. 8 is a block diagram that schematically illustrates an example of the configuration of a driving device according to an exemplary embodiment of the invention.
Figure 9:
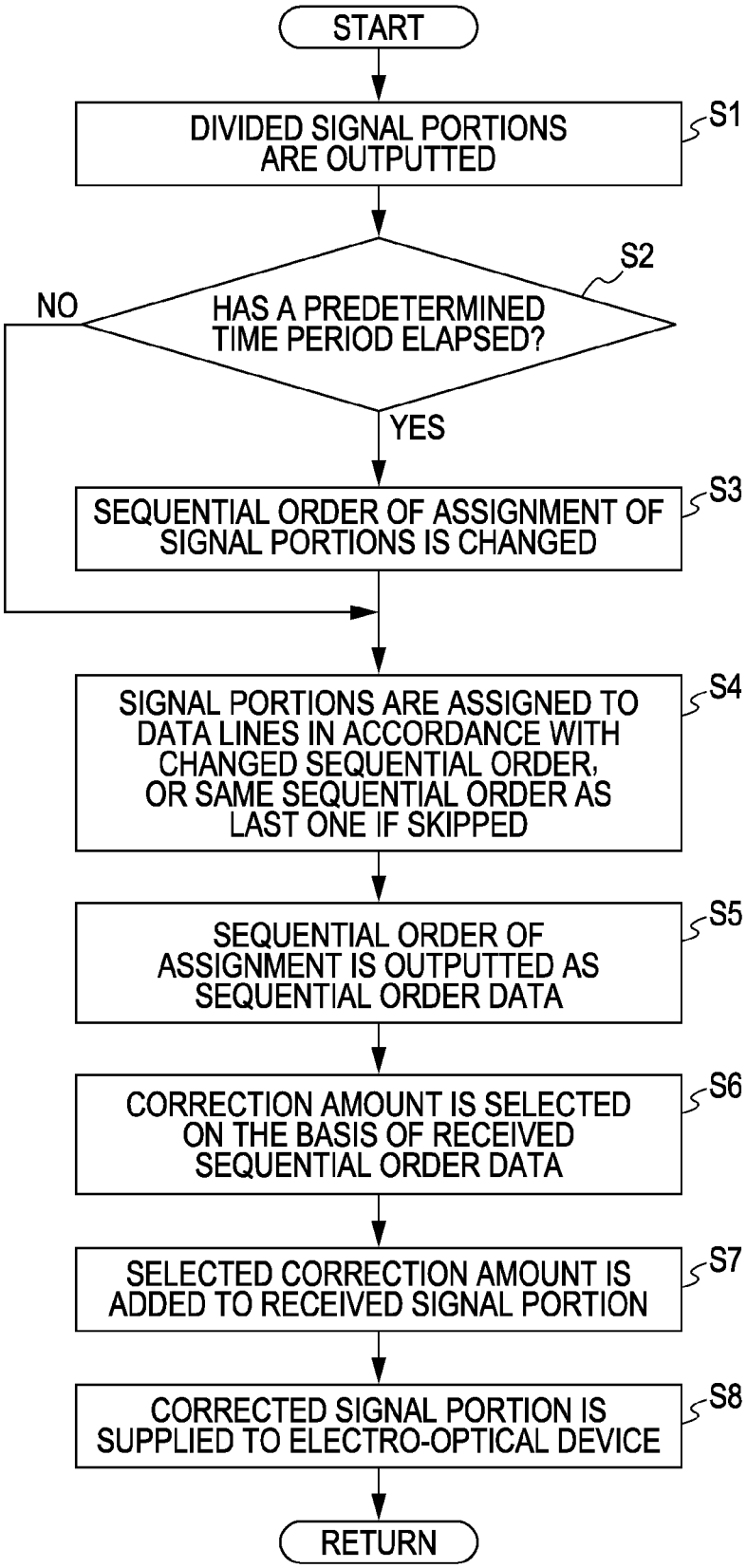
FIG. 9 is a flowchart that schematically illustrates an example of the operation of a driving device according to an exemplary embodiment of the invention.
Figure 11:
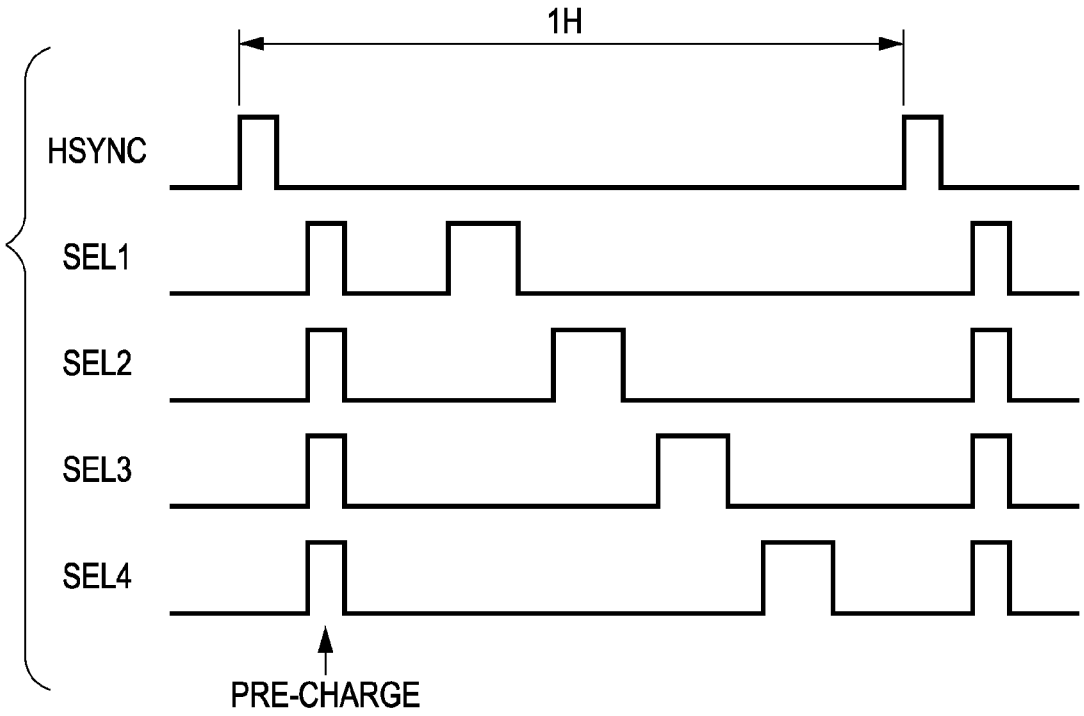
FIG. 11 is a timing chart that shows an example of timing signals that are outputted from a driving device according to an exemplary embodiment of the invention.
Figure 12:
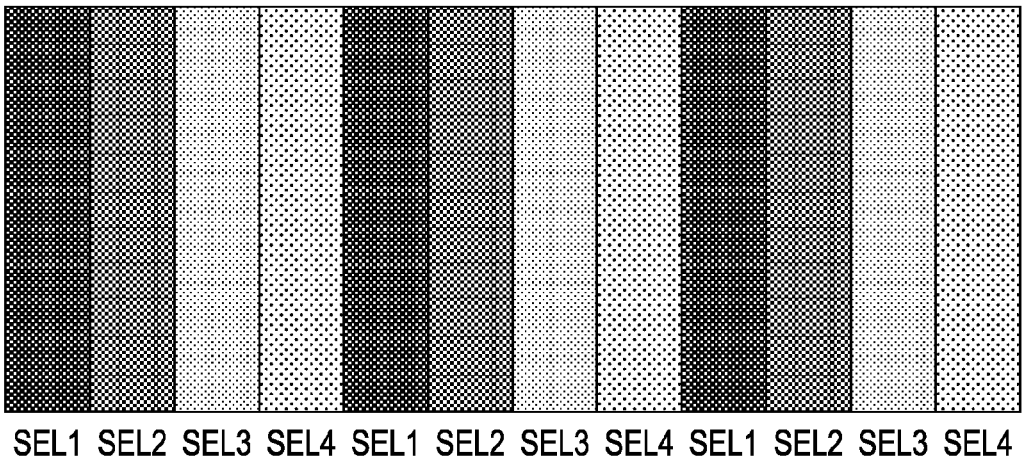
FIG. 12 is a diagram that shows, for each data line, a brightness difference that occurs in an electro-optical device.

Next, with reference to FIGS. 8-12, a flow of the operation of an electro-optical-device driving device according to the present embodiment of the invention is explained below. In addition, an explanation is given of the advantageous effects of an electro-optical-panel driving device according to the present embodiment of the invention. FIG. 8 is a block diagram that schematically illustrates an example of the configuration of an electro-optical-panel driving device according to the present embodiment of the invention. FIG. 9 is a flowchart that schematically illustrates an example of the operation of an electro-optical-panel driving device according to the present embodiment of the invention. FIG. 10 is a matrix diagram that schematically illustrates an example of the sequential order of the assignment of signal portions, which is performed by an electro-optical-panel driving device according to the present embodiment of the invention. FIG. 11 is a timing chart that shows an example of timing signals that are outputted from an electro-optical-panel driving device according to the present embodiment of the invention. FIG. 12 is a diagram that shows, for each data line, a brightness difference that occurs in an electro-optical device.

In order to facilitate the understanding of the invention, in the following description of this specification, it is explained that an electro-optical-device driving device according to the present embodiment of the invention has functional units shown in FIG. 8. That is, an electro-optical-panel driving device according to the present embodiment of the invention is provided with an output unit 110, an assignment unit 120, a sequential order change unit 130, a correction amount selection unit 140, a correction unit 150, and a supply unit 160. The output unit 110 described herein is a non-limiting example of an "outputting section" according to an aspect of the invention. The assignment unit 120 described herein is a non-limiting example of an "assigning section" according to an aspect of the invention. The sequential order change unit 130 described herein is a non-limiting example of a "changing section" according to an aspect of the invention. The correction amount selection unit 140 described herein is a non-limiting example of a "correction amount selecting section" according to an aspect of the invention. The correction unit 150 described herein is a non-limiting example of a "correcting section" according to an aspect of the invention. Finally, the supply unit 160 described herein is a non-limiting example of a "supplying section" according to an aspect of the invention. It should be noted that these operation components include or at least conceptualize the entire or partial function of, for example, the controlling circuit 5, the frame memory 6, and the data line driving circuit 103, each of which is shown in FIG. 4. In addition, these operation components may include any other ICs, memories, wiring, and/or other parts, components, or members that are not specifically shown in FIG. 4.

Upon the start of the operation of an electro-optical-device driving device according to the present embodiment of the invention, as a first step of the operation flow thereof, as shown in FIG. 9, the output unit 110 divides an original non-corrected image signal into a plurality of signal portions and then outputs the plurality of divided signal portions (step S1). That is, an original non-corrected image signal is split into a plurality of signal portions whose number equals to the number of groups of data lines. The divided original non-corrected signal portions are outputted from the output unit 110.

Upon the inputting of these signal portions into the assignment unit 120, the sequential order change unit 130 makes a judgment as to whether a predetermined time period has elapsed since the last change in sequential order or not (step S2). For example, one horizontal time period or one frame time period is set as the above-mentioned predetermined time period, though not limited thereto. If the sequential order change unit 130 judges that a predetermined time period has elapsed since the last change in sequential order (step S2: YES), the sequential order change unit 130 outputs selection signals to the assignment unit 120 so that the sequential order of the assignment of signal portions should be changed (step S3).

Herein, the changing of the sequential order of signal-portion assignment described above is performed on the basis of the result of brightness-difference simulation, which has been performed in advance so as to simulate the luminance difference of the image display region of an electro-optical device. For example, an optimum sequential order that minimizes the brightness difference in an electro-optical panel is found as a result of experiment, which can be performed as follows, without any limitation thereto. While actually changing the sequential order of the assignment of signal portions, a display image is visually inspected. Then, an optimum sequential order that minimizes the difference in brightness is found as a result of visual observation. Or, alternatively, the brightness levels may be compared with one another while actually changing the sequential order thereof so as to find an optimum sequential order that minimizes the luminance difference. Information on such an experimentally found sequential order is stored in a memory device or the like that is provided in the sequential order change unit 130.

On the other hand, if is judged that a predetermined time period has not elapsed yet since the last change in sequential order (step S2: NO), the step S3 explained above is skipped. In this case, the changing of the sequential order of signal-portion assignment described above is not performed.

If the predetermined time period mentioned above is set as one horizontal scanning interval 1H, which corresponds to a time period during which one horizontal scan operation is performed, the changing of the sequential order of signal-portion assignment explained above is performed at each lapse of the horizontal scan time period 1H. FIG. 10 shows an example of the changing of the sequential order of signal-portion assignment at each lapse of the horizontal scanning interval 1H. A more specific explanation of the changing of the sequential order of signal-portion assignment is given below. In the following description, as illustrated in FIG. 10, a first (output line) group of data lines, which is made up of the data lines X1, X2, X3, and X4, and a second (output line) group of data lines, which is made up of the data lines X5, X6, X7, and X8, are taken for example. Note that one signal portion is supplied to the first group of the data lines X1, X2, X3, and X4 through the first output line DO1, whereas another signal portion is supplied to the second group of the data lines X5, X6, X7, and X8 through the second output line DO2. The sequential order of the assignment of signal portions to these data lines X1, X2, X3, and X4 (as well as X5, X6, X7, and X8) is changed in accordance with, for example, the matrix diagram of FIG. 10. That is, the sequential order of the assignment of signal portions to these data lines X is changed with regularity. Four horizontal scan intervals 4H equal to the cycle of such a regular change pattern.

Generally speaking, the brightness level (i.e., luminance level) of the image display area 10*a* (refer to FIG. 1) of an electro-optical device could differ depending on a timing difference in the supply of signal portions to the data lines X. In other words, the brightness level of the image display area 10*a* of an electro-optical device could differ depending on the sequential order of the assignment of signal portions to the data lines X. In contrast, if these signal portions are assigned to the data lines X in accordance with a cyclic sequential order that changes with regularity, a non-limiting example of which is shown in FIG. 10, it is possible to make the timing of the supply of these signal portions to the data lines X uniform. As a result of a substantially reduced timing difference in the supply of the signal portions to the data lines X, it is possible to prevent the occurrence of unevenness in display or other similar display failure, which could otherwise occur due to a difference in brightness.

However, although such a change in the sequential order of the assignment of signal portions to the data lines X explained above is quite effective for the reduction of display unevenness, it could have the opposite visual effect; that is, in some cases, a brightness difference might become more visually perceivable as a result of such a change in the sequential order of the assignment of signal portions to the data lines X. The reason why a brightness difference might become more visually perceivable as a result of such a change in the sequential order of the assignment of signal portions to the data lines X is as follows. When the sequential order of the assignment of signal portions to the data lines X is changed, some area portion at which a brightness level differs from that of other area portion moves in accordance with the changed sequential order thereof in the image display area 10*a* (refer to FIG. 1). Accordingly, for example, the movement of a high luminance area portion becomes more visually perceivable. As a disadvantageous effect of such movement of a high brightness area portion, the flickering of a display screen, though not limited thereto, could be visually recognized. That is, although such a change in the sequential order of the assignment of signal portions to the data lines X explained above is quite effective for the reduction of display unevenness, it could have the opposite visual effect of the occurrence of flickers or other similar image problems. In order to overcome the problem of flickers or other similar image problems due to the reason explained above, an electro-optical-device driving device according to the present embodiment of the invention corrects the gradations of signal portions. A more detailed explanation of the correction thereof will be given later.

Referring back to the flowchart of FIG. 9, the assignment unit 120 assigns the signal portions to the data lines X in accordance with the changed sequential order, which is specified by the sequential order change unit 130 with the use of the aforementioned selection signals (step S4). If the step S3 is skipped as explained above, the assignment unit 120 assigns the signal portions to the data lines X in accordance with the same sequential order as that of the last assignment in this step S4. For assigning these signal portions to the data lines X, the assignment unit 120 generates, for example, a set of timing signals. More specifically, the assignment unit 120 generates a set of timing signals SEL1, SEL2, SEL3, and SEL4 that indicates the respective timing of the supply of these signal portions to the data lines X. A horizontal clock signal HSYNC that specifies, for example, the horizontal scan time period 1H is used as a reference clock for these timing signals SEL1-4. A non-limiting example of these timing signals SEL1-4 and the horizontal clock signal HSYNC is shown in FIG. 11.

In the illustrated exemplary configuration, each timing signal indicates not only the timing of the corresponding signal portions to the corresponding data lines X but also the timing of the application of a pre-charge voltage (that is, the correction data damd shown in FIG. 6, which will be converted into the pre-charge voltage). Since a pre-charge signal is applied prior to the supply of the signal portion, it is possible to prevent a vertical crosstalk or other similar image problem from occurring. The vertical crosstalk is a kind of display unevenness that appears along the extending direction of the data lines X. If a set of timing signals SEL1, SEL2, SEL3, and SEL4 has a timing pattern shown in FIG. 11, signal portions are assigned to the data lines X of an electro-optical device in accordance with the sequential order shown therein, that is, in accordance with the order of appearance shown in this sentence. That is, first, signal portions are assigned to the data lines X corresponding to the timing signal SEL1 (e.g., the data line X1 shown in FIG. 4, though not limited thereto), which is followed by the assignment of signal portions to the data lines X corresponding to the timing signal SEL2 (e.g., the data line X2 shown in FIG. 4, though not limited thereto). Thereafter, signal portions are assigned to the data lines X corresponding to the timing signal SEL3 (e.g., the data line X3 shown in FIG. 4, though not limited thereto), which is followed by the assignment of signal portions to the data lines X corresponding to the timing signal SEL4 (e.g., the data line X4 shown in FIG. 4, though not limited thereto).

After the completion of the assignment of these signal portions to the data lines X, the assignment unit 120 outputs the sequential order of assignment to the correction amount selection unit 140 as sequential order data (step S5). The correction amount selection unit 140 selects the amount of correction on the basis of the received sequential order data (step S6). The correction amount that is selected by the correction amount selection unit 140 is outputted to the correction unit 150 in accordance with the timing of the correction target signal portion.

The amount of correction explained above is a value that is used for correcting the gradation of the signal portion. Typically, a set of correction amounts is predetermined in such a manner that the number thereof equals to the number of the data lines X that make up each data line group. Since it is assumed in the description of this specification as well as in the illustration of the accompanying drawings that each data line group consists of four data lines X as explained earlier, a set of four correction amounts hd1, hd2, hd3, and hd4 is preset as shown in FIG. 8.

These correction amounts are predetermined on the basis of the result of brightness-difference simulation, which has been performed in advance so as to simulate the luminance difference of an electro-optical device. For example, an optimum set of correction amounts that minimizes the brightness difference in an electro-optical panel is found as a result of experiment, which can be performed as follows, without any limitation thereto. While actually changing correction amount, a display image is visually inspected. Then, an optimum set of correction amounts that minimizes the difference in brightness is found as a result of visual observation. Or, alternatively, the brightness levels may be compared with one another while actually changing correction amount so as to find an optimum set of correction amounts that minimizes the luminance difference.

For example, if signal portions are supplied to the data lines X in accordance with the set of timing signals SEL1-4 shown in FIG. 11 without any correction, a brightness difference will be observed in the display panel of an electro-optical device as shown in FIG. 12. That is, in such a case, a brightness difference will be observed in the display panel of an electro-optical device in accordance with the sequential order of the supply of the signal portions. If an optimum set of correction amounts for minimizing the brightness difference in an electro-optical panel, which can be experimentally found as a result of simulation, is preset, it is possible to effectively avoid the occurrence of such a brightness-difference problem.

Referring back to the flowchart of FIG. 9, the correction unit 150 adds a correction amount that is selected by the correction amount selection unit 140 to the received signal portion (step S7). Then, the supply unit 160 supplies the corrected signal portion to an electro-optical device (step S8). Upon reception thereof, the electro-optical device performs image display on the basis of the corrected signal portions. The brightness difference of the corrected signal portion has been substantially reduced from that of uncorrected one (refer to FIG. 12). Thus, while preventing the occurrence of display unevenness or other similar display failure due to a difference in brightness, an electro-optical-device driving device according to the present embodiment of the invention makes it possible to prevent the occurrence of flicker, though not limited thereto, which is an image problem that is attributable to a change in the sequential order of the assignment of signal portions to data lines.

As explained above, a driving device according to the present embodiment of the invention corrects signal portions so as to reduce a difference in brightness of the image display area of an electro-optical device. Therefore, if the configuration of a driving device according to the present embodiment of the invention is adopted, it is possible to prevent the occurrence of flicker or other similar image problem, which is attributable to a change in the sequential order of the assignment of signal portions to data lines, while preventing the occurrence of display unevenness or other similar display failure due to a brightness difference. Thus, a driving device according to the present embodiment of the invention makes it possible to display an image with high quality.

Electronic Apparatus

Figure 13:
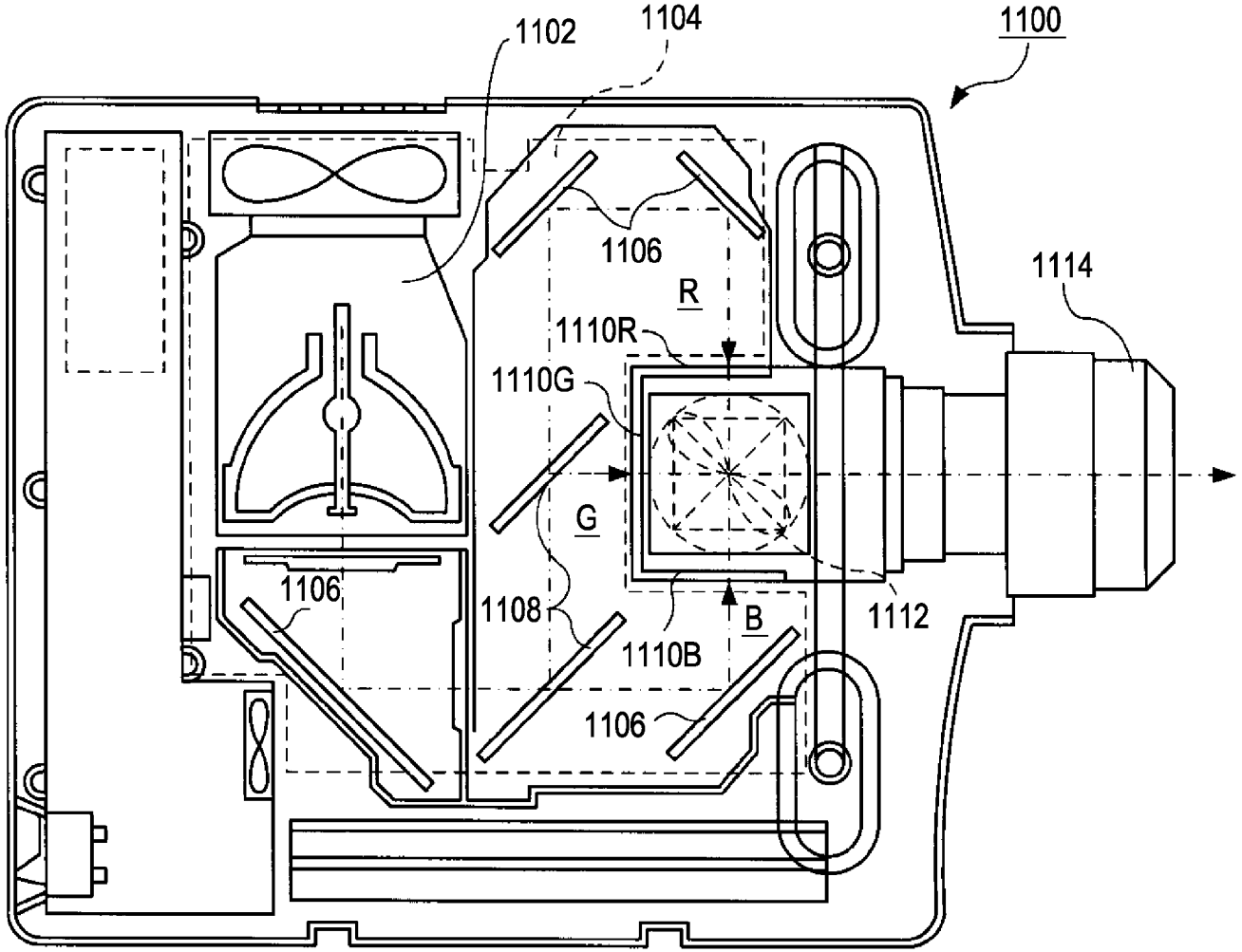
FIG. 13 is a plan view that schematically illustrates an example of the configuration of a projector, which is an example of electronic apparatuses to which an electro-optical device according to an aspect of the invention is applied.

Next, an explanation is given of an example of the applications of a liquid crystal device described above, which is a non-limiting example of an electro-optical device according to an aspect of the invention, to various kinds of electronic apparatuses. FIG. 13 is a plan view that schematically illustrates an example of the configuration of a projector. In the following description, an explanation is given of a projector that employs the above-described liquid crystal device as a light valve.

As illustrated in FIG. 13, a lamp unit 1102, which is made of a white light source such as a halogen lamp, is provided in a projector 1100. A projection light beam that is emitted from the lamp unit 1102 is separated into three primary color components of R, G, and B by four mirrors 1106 and two dichroic mirrors 1108 arranged in a light guide 1104. The separated primary color components of R, G, and B enter liquid crystal panel 1110R, 1110G, and 1110B, respectively, which function as light valves corresponding to the respective primary color components.

The configuration of the liquid crystal panel 1110R, 1110G, or 1110B is the same as or similar to that of the liquid crystal device described above. Each of these liquid crystal panels 1110R, 1110G, and 1110B is driven by the corresponding one of the primary color signals R, G, and B, which are supplied from an image signal processing circuit. Light subjected to optical modulation by one of these liquid crystal panels enters a dichroic prism 1112 from the corresponding one of three directions. Light of R color component and light of B color component are refracted at a 90-degree angle at the dichroic prism 1112, whereas light of G color component goes straight through the dichroic prism 1112. Therefore, as a result of combination of these color components, a color image is projected on a screen, etc., through a projection lens 1114.

Focusing attention on a display image offered by each of the liquid crystal panels 1110R, 1110G, and 1110B, it is necessary to reverse the display image of the liquid crystal panel 1110G in a mirror pattern (that is, to reverse the left side and the right side) with respect to the display images of the liquid crystal panels 1110R and 1110B.

Because light corresponding to each one of the primary colors R, G, and B goes in the corresponding one of the liquid crystal panel 1110R, 1110G, and 1110B thanks to the presence of the dichroic mirror 1108, it is not necessary to provide a color filter thereon.

Among a variety of electronic apparatuses to which the electro-optical device according to an aspect the invention could be embodied are, in addition to the electronic apparatus (projector) explained above with reference to FIG. 13, a mobile-type personal computer, a mobile phone, a liquid crystal display television (i.e., liquid crystal television, LCD television), a viewfinder-type video recorder, a video recorder of a direct monitor view type, a car navigation device, a pager, an electronic personal organizer, an electronic calculator, a word processor, a workstation, a videophone, a POS terminal, a touch-panel device, and so forth. Needless to say, the invention is also applicable to these various electronic apparatuses without any limitation to those enumerated/mentioned above.

In addition to the liquid crystal device explained in the exemplary embodiments described above, the invention is also applicable to a reflective liquid crystal display which has elements formed on a silicon substrate (LCOS, liquid crystal on silicon), a plasma display (PDP), a field emission display (FED), a surface-conduction electron-emitter display (SED), an organic EL display, a digital micro mirror device (DMD), an electrophoresis apparatus, to name but a few.

The present invention should be in no case interpreted to be limited to the specific embodiments described above. The invention may be modified, altered, changed, adapted, and/or improved within a range not departing from the gist and/or spirit of the invention apprehended by a person skilled in the art from explicit and implicit description given herein as well as recitation of appended claims. A driving device subjected to such modification, alteration, change, adaptation, and/or improvement, a driving method subjected to such modification, alteration, change, adaptation, and/or improvement, an electro-optical device that is driven by and/or is provided with such a driving device and/or is driven by such a driving method, and an electronic apparatus that is provided with such an electro-optical device are also within the technical scope of the invention.

The entire disclosure of Japanese Patent Application No. 2007-291961, filed Nov. 9, 2007 is expressly incorporated by reference herein.

What is claimed is:

1. A driving device for driving an electro-optical device, the driving device correcting an original image signal that indicates an image that is to be displayed in a display area of the electro-optical device, the driving device supplying the corrected image signal to a plurality of data lines in the display area of the electro-optical device, the data lines including groups of the data lines each comprising a predetermined number of data lines, the driving device comprising:

an outputting section that divides the original image signal into a number of signal portions, the number corresponding to the number of groups of the data lines, the outputting section outputting the signal portions;

an assigning section that assigns the signal portions to the data lines of corresponding group;

a changing section that determines an order that the signal portions are to be supplied to the data lines of the corresponding group and changes the order into a changed order;

a correcting section that corrects the signal portions to reduce a difference in brightness in the display area generated by the changed order of the signal portions; and a supplying section that supplies the corrected signal portions to the data lines in accordance with the changed order, wherein the changing section changes the sequential order of the assignment of each of the signal portions to the predetermined number of data lines that make up the corresponding group so as to reduce a difference in brightness in the display area of the electro-optical device, which is attributable to a change in the sequential order of the assignment of each of the signal portions to the predetermined number of data lines that make up the corresponding group.

2. The driving device according to claim 1, wherein the changing section supplies a selection signal for selecting the sequential order to the assigning section and thereby controls the assigning section so that the sequential order should be changed.

3. The driving device according to claim 1, wherein the correcting section corrects the gradations of the signal portions on the basis of a predetermined amount of correction that is set in accordance and which corresponds with the sequential order.

4. The driving device according to claim 3, wherein the correcting section has a correction amount selecting section that selects the predetermined amount of correction in accordance with the sequential order; and the correcting section corrects the gradations of the signal portions on the basis of the selected amount of correction.

5. A driving device for driving an electro-optical device, the driving device correcting an original image signal that indicates an image that is to be displayed in a display area of the electro-optical device, the driving device supplying the corrected image signal to a plurality of data lines in the display area of the electro-optical device, the data lines including groups of the data lines each comprising a predetermined number of data lines, the driving device comprising:

an outputting section that divides the original image signal into a number of signal portions, the number corresponding to the number of groups of the data lines, the outputting section outputting the signal portions;

an assigning section that assigns the signal portions to the data lines of corresponding group;

a changing section that determines an order that the signal portions are to be supplied to the data lines of the corresponding group and changes the order into a changed order;

a correcting section that corrects the signal portions to reduce a difference in brightness in the display area generated by the changed order of the signal portions; and a supplying section that supplies the corrected signal portions to the data lines in accordance with the changed order, wherein the changing section changes the sequential order of the assignment of each of the signal portions to the predetermined number of data lines that make up the corresponding group in accordance with a predetermined change rule.

6. A driving device for driving an electro-optical device, the driving device correcting an original image signal that indicates an image that is to be displayed in a display area of the electro-optical device, the driving device supplying the corrected image signal to a plurality of data lines in the display area of the electro-optical device, the data lines including groups of the data lines each comprising a predetermined number of data lines, the driving device comprising:

an outputting section that divides the original image signal into a number of signal portions, the number corresponding to the number of groups of the data lines, the outputting section outputting the signal portions;

an assigning section that assigns the signal portions to the data lines of corresponding group;

a changing section that determines an order that the signal portions are to be supplied to the data lines of the corresponding group and changes the order into a changed order;

a correcting section that corrects the signal portions to reduce a difference in brightness in the display area generated by the changed order of the signal portions; and a supplying section that supplies the corrected signal portions to the data lines in accordance with the changed order, wherein the changing section changes the sequential order of the assignment of each of the signal portions to the predetermined number of data lines that make up the corresponding group for each predetermined time period or for each set time period.

7. An electro-optical device that is provided with the driving device according to claim 1.

8. An electronic apparatus that is provided with the electro-optical device according to claim 7.

9. The driving device according to claim 5, wherein the changing section supplies a selection signal for selecting the sequential order to the assigning section and thereby controls the assigning section so that the sequential order should be changed.

10. The driving device according to claim 5, wherein the correcting section corrects the gradations of the signal portions on the basis of a predetermined amount of correction that is set in accordance and which corresponds with the sequential order.

11. The driving device according to claim 10, wherein the correcting section has a correction amount selecting section that selects the amount of correction in accordance with the sequential order; and the correcting section corrects the gradations of the signal portions on the basis of the selected amount of correction.

12. An electro-optical device that is provided with the driving device according to claim 5.

13. An electronic apparatus that is provided with the electro-optical device according to claim 5.

14. The driving device according to claim 6, wherein the changing section supplies a selection signal for selecting the sequential order to the assigning section and thereby controls the assigning section so that the sequential order should be changed.

15. The driving device according to claim 6, wherein the correcting section corrects the gradations of the signal portions on the basis of a predetermined amount of correction that is set in accordance and which corresponds with the sequential order.

16. The driving device according to claim 15, wherein the correcting section has a correction amount selecting section that selects the amount of correction in accordance with the sequential order; and the correcting section corrects the gradations of the signal portions on the basis of the selected amount of correction.

17. An electro-optical device that is provided with the driving device according to claim 6.

18. An electronic apparatus that is provided with the electro-optical device according to claim 6.

* * * * *